US008528352B2

(12) United States Patent
Kawamukai et al.

(10) Patent No.: US 8,528,352 B2
(45) Date of Patent: Sep. 10, 2013

(54) DEFROST TIMER FOR REFRIGERATOR AND REFRIGERATOR

(75) Inventors: Takatomo Kawamukai, Oura-gun (JP); Kazutoyo Fukukura, San Diego, CA (US)

(73) Assignee: Sanyo E&E Corporation, San Diego, CA (US)

( * ) Notice: Subject to any disclaimer, the term of this patent is extended or adjusted under 35 U.S.C. 154(b) by 977 days.

(21) Appl. No.: 12/586,608

(22) Filed: Sep. 23, 2009

(65) Prior Publication Data

US 2011/0067423 A1 Mar. 24, 2011

(51) Int. Cl.
*F25D 21/06* (2006.01)

(52) U.S. Cl.
USPC ..... 62/151; 62/155; 62/234

(58) Field of Classification Search
USPC ..... 62/151, 155, 228.1, 234
See application file for complete search history.

(56) References Cited

U.S. PATENT DOCUMENTS 3,922,874 A * 12/1975 Canter ..... 62/155
4,327,557 A 5/1982 Clarke et al.
7,245,475 B2 7/2007 Huber et al.
2007/0125103 A1 6/2007 Lee

FOREIGN PATENT DOCUMENTS

JP 2007292332 A * 11/2007

OTHER PUBLICATIONS

Renesas, R8C/28 Group, R8C/29 Group, product specification, Sep. 26, 2008, p. 1-p. 67, Renesas Technology Corp.

* cited by examiner

*Primary Examiner* — Marc Norman
(74) *Attorney, Agent, or Firm* — Masuvalley & Partners

(57) ABSTRACT

The defrost timer is typically provided to remove frost on an evaporator in a refrigerator. The defrost timer includes a circuit board, a first terminal, a second terminal, a third terminal, a fourth terminal, a switching unit, a first AC line, a second AC line, a third AC line and a fourth AC line. The first AC line is provided on the circuit board and connects the first terminal and the switching unit. The second AC line is provided on the circuit board and connects the second terminal and the switching unit. The third AC line is provided on the circuit board and connects the third terminal and the switching unit. The fourth AC line is provided on the circuit board and connects the fourth terminal and the switching unit. Distance between the third AC line and the fourth AC line is at least 5 mm.

15 Claims, 13 Drawing Sheets

DEFROST TIMER FOR REFRIGERATOR AND REFRIGERATOR

TECHNICAL FIELD

The present invention relates to a defrost timer used for a refrigerator and a refrigerator having such a defrost timer.

BACKGROUND OF THE INVENTION

While refrigerators are running, their coolers, also called evaporators of the refrigerators, are frosted and often get ice condensed on the coolers. Such frost and ice must be removed periodically for a smooth operation of the refrigerator. For this purpose, many refrigerators have defrost timers. The defrost timer turns off periodically a compressor of the refrigerator so that it allows the temperature of the evaporator to be high enough to melt and dry the ice and frost formed on the evaporator.

Since refrigerators are ubiquitous appliances, there is a high demand to lower the cost of refrigerators, their replacement parts and maintenance fees. At the same time, durable refrigerators are desired because it is burdensome and costly to fix or replace the refrigerators. Nowadays, some consumers want a refrigerator that lasts for two decades.

One bottleneck to realize durable refrigerators is their defrost timer. A typical defrost timer is made of mechanical parts such as a motor, gears, cams and levers, which are designed to count time and turn off the evaporator at a preset time. Mechanical defrost timers are cost-effective due to the facts that they do not contain numerous components and each component is not an expensive part. However, their mechanical components make it difficult to produce a durable defrost timer that lasts over a decade. Because the mechanical components keep receiving forces and moving all the time, they are easily worn out. In addition, the mechanical defrost timer makes ticking or clicking noise, which can be heard in a quit room. Some people mind such noise in late night. Therefore, quiet defrost timers are required to make the refrigerator more quiet.

SUMMARY OF THE INVENTION

One aspect of the present invention is a defrost timer for refrigerator, including a circuit board, a first terminal, a second terminal, a third terminal, a fourth terminal, a switching unit, a first AC line, a second AC line, a third AC line and a fourth AC line. The first terminal is located on the circuit board and is coupled to one position of an alternative current source. The second terminal is located on the circuit board and is coupled to a heater of the refrigerator. The third terminal is located on the circuit board and is coupled to other position of the alternative current source. The fourth terminal is located on the circuit board and is coupled to a compressor of the refrigerator. The switching unit is electively coupled between the first terminal and the fourth terminal. The first AC line is provided on the circuit board and is coupling the first terminal and the switching unit. The second AC line is provided on the circuit board and is coupling the second terminal and the switching unit. The third AC line is provided on the circuit board and is coupling the third terminal and the switching unit. The fourth AC line is provided on the circuit board and is coupling the fourth terminal and the switching unit. The distance between the third AC line and the fourth AC line is at least 5 mm.

Another aspect of the present invention is a defrost timer for refrigerator, including a switching unit, a timer unit and a DC supply unit. The switching unit is electively coupled to a compressor of the refrigerator. The timer unit controls the switching unit according to a counted time. The DC supply unit supplies direct current to the timer unit. It is preferable that the switching unit contains a photocoupler and an AC relay, both parts of which are coupled to each other in series and both parts of which are coupled to an AC line in parallel. It is preferable that the timer unit contains a timer for counting a time, a CPU for controlling the switching unit according to the time counted by the timer, and a flash memory for storing data outputted from the CPU. It is preferable that the DC supply unit contains a capacitor coupled in series to an AC source, a bridge diode coupled between the AC source, and a zener diode coupled in parallel to the bridge diode.

Another aspect of the present invention is a defrost timer for refrigerator, including a switching unit, a timer, a CPU and a flash memory. The switching unit is selectively coupled to a compressor of the refrigerator. The timer counts a time. The CPU controls the switching unit according to the time counted by the timer. The flash memory stores data outputted from the CPU. The CPU is configured to write periodically a value reflecting the time counted by the timer into the flash memory and control the switching unit and turn off the compressor when the value reaches a predetermined threshold.

Another aspect of the present invention is a defrost timer for refrigerator, including a switching unit, a CPU and a flash memory. The switching unit is selectively coupled to a compressor of the refrigerator or a heater of the refrigerator. The CPU controls the switching unit. The flash memory stores data outputted from the CPU. The CPU is configured to write periodically a value reflecting a running time of the compressor into the flash memory and control the switching unit and turn off the compressor or the heater when the value reaches a predetermined threshold.

Another aspect of the present invention is a refrigerator having a compressor, a condenser, an evaporator to compress, condense and evaporate a coolant, and a defrost timer coupled in series to the compressor. The defrost timer is the defrost timer as described above.

Another aspect of the present invention is a refrigerator having a compressor, a condenser, an evaporator, a thermostat, an optional heater and a defrost timer. The compressor, the condenser and the evaporator compresses, condenses and evaporates a coolant. The thermostat is coupled in series to the compressor. The thermostat selectively couples an alternative current source to the compressor. The heater warms the evaporator. The defrost timer is coupled in series to the compressor and the thermostat. The defrost timer is the defrost timer as described above. Current to the defrost timer is arranged to be off while the current to the compressor is off by the thermostat.

DETAILED DESCRIPTION OF INVENTION

Embodiments of the present invention relates in general to a defrost timer and refrigerators containing the defrost timer. It is specifically relates to a new generation of electrical defrost timers where specific examples are described in detail.

§1. Defrost Timer 100

FIGS. 1-9 represent the preferred exemplary embodiments of the present invention, describing a defrost timer 100. The defrost timer 100 is a control device that turns on and off a compressor of the refrigerator. More specifically, the defrost timer 100 switches off the compressor at a certain time for a predetermined period. Thereby, frost and ice on an evaporator of the refrigerator are removed. Because the defrost timer 100 has features described further below, the defrost timer 100 is quiet and durable. In addition, the defrost timer 100 is cost-effective, thereby inexpensive to produce.

§1.1 Overview of the Defrost Timer 100

Figure 1:
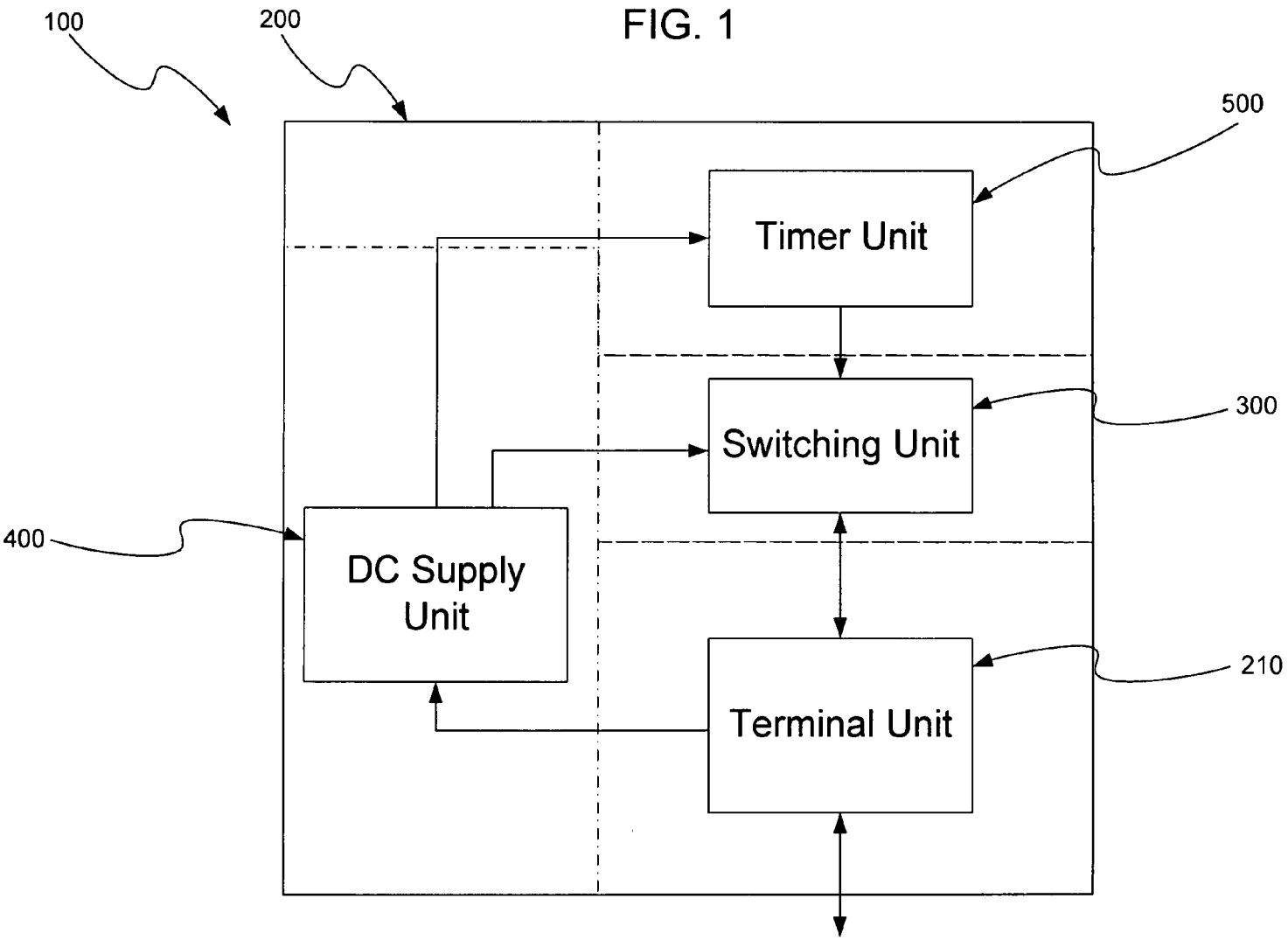
FIG. 1 depicts a block diagram of an embodiment of a defrost timer showing an approximate occupied area of different units.

Referring first to FIG. 1, a block diagram of the defrost timer 100 is shown. The defrost timer 100 may include a terminal unit 210, a switching unit 300, a DC supply unit 400, and a timer unit 500. These units are provided on a quadrilateral printed circuit board (PCB) 200, where electrical connections of the defrost timer 100 are physically supported. FIG. 1 also shows approximate positions and areas, occupied by different units of the defrost timer 100, on the circuit board 200.

The terminal unit 210 provides electrical connections to an alternating current (AC) source, to a compressor and, if necessary, a heater of the refrigerator. The compressor and the heater of the refrigerator are positioned outside of the defrost timer 100. The switching unit 300 turns on and off the electrical connection between the compressor and the AC power source. The timer unit 500 controls the switching unit 300 by counting a time internally. The DC supply unit 400 provides a direct current (DC) to the timer unit 500.

§1.2 Circuit Design of the Defrost Timer 100

Figure 2:
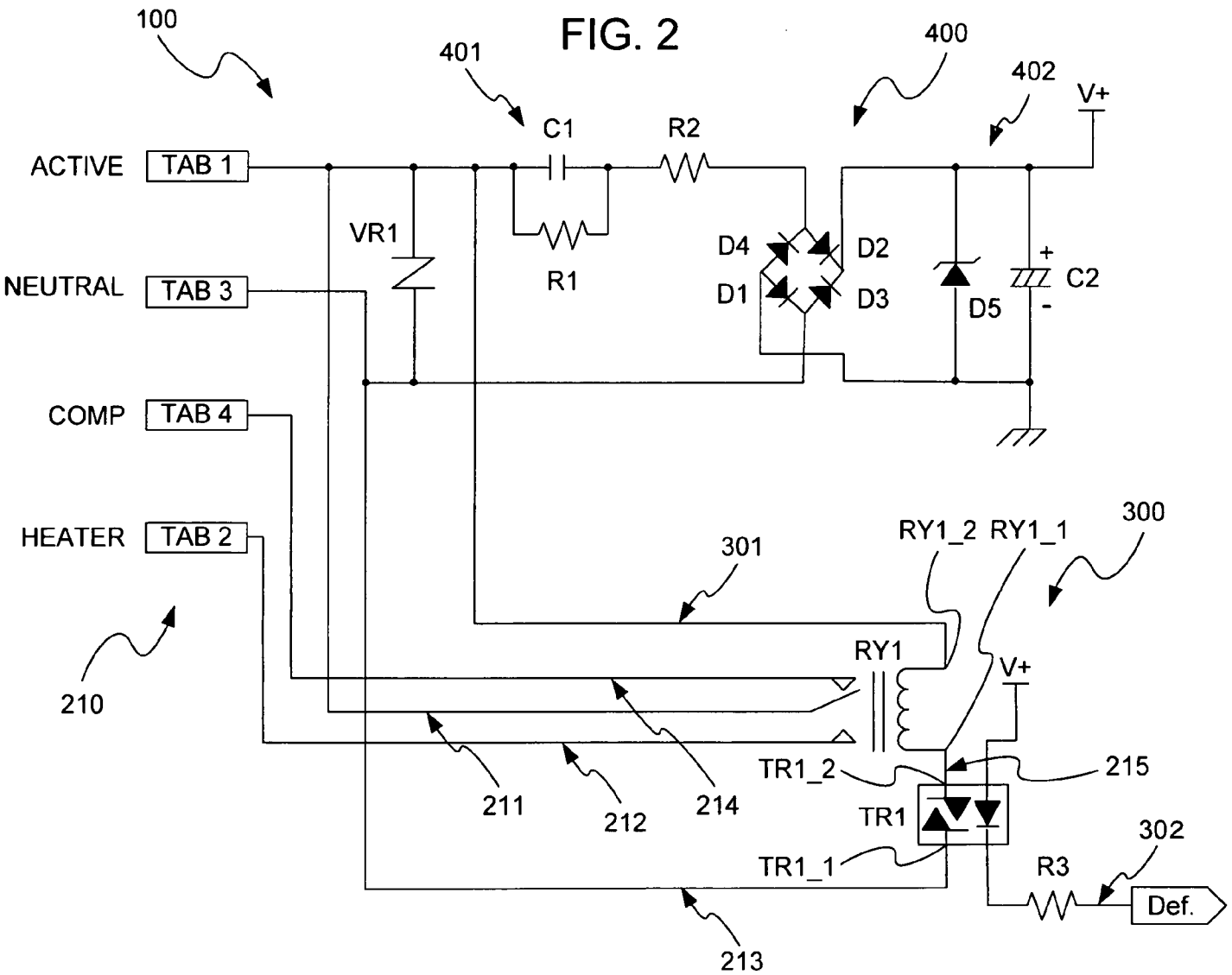
FIG. 2 depicts a circuit diagram of an embodiment of a defrost timer illustrating a terminal unit, a switching unit and a DC supply unit.
Figure 3:
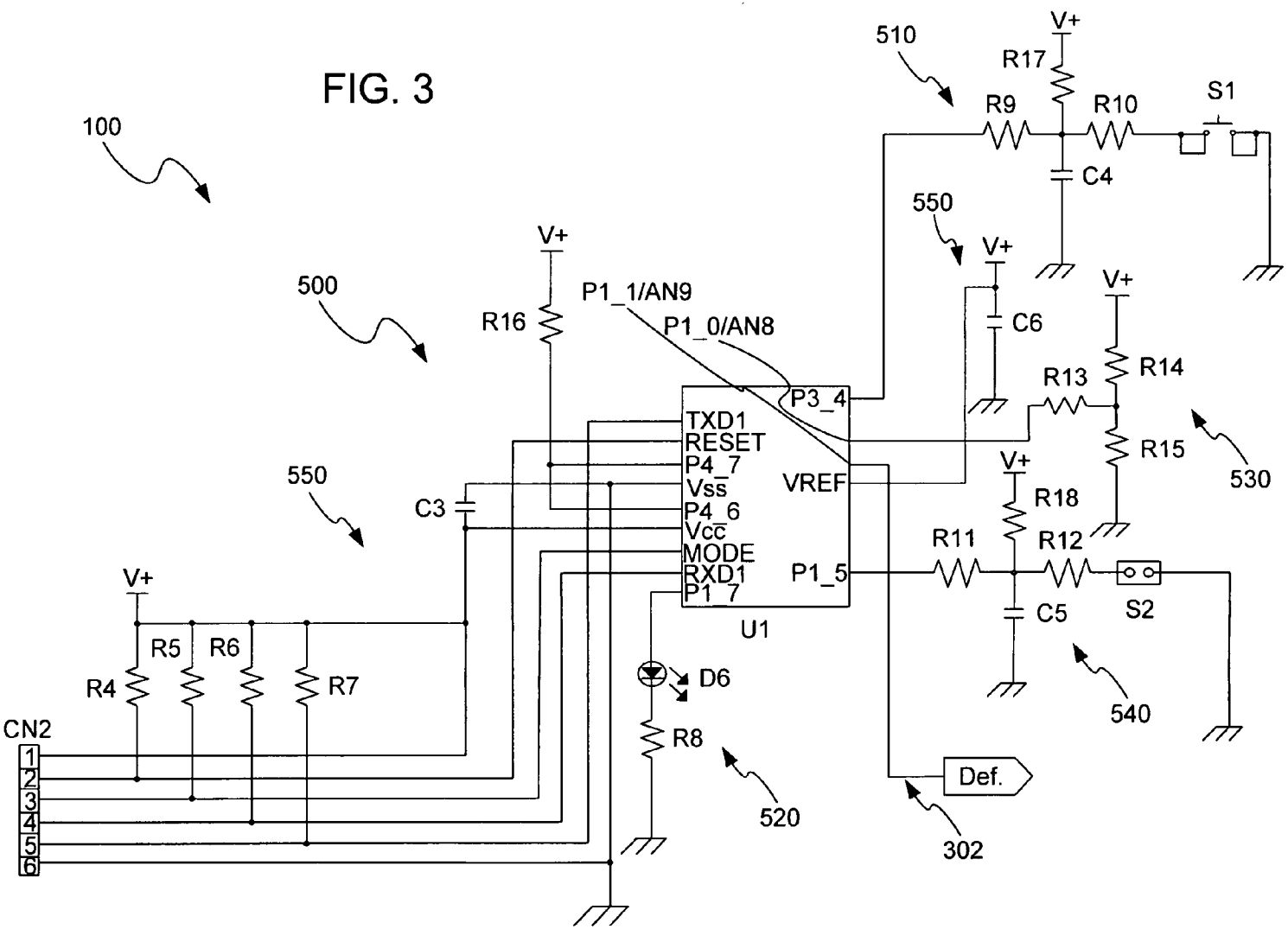
FIG. 3 depicts a circuit diagram of an embodiment of a defrost timer illustrating a timer unit.

FIGS. 2-3 illustrate a circuit diagram for each unit of the defrost timer 100. The terminal unit 210, the switching unit 300 and the DC supply unit 400 are shown in FIG. 2. The timer unit 500 is shown in FIG. 3.

§1.2.1 Terminal Unit 210 and Switching Unit 300

As shown in FIG. 2, the terminal unit 210 may include an active terminal TAB1, a heater terminal TAB2, a neutral terminal TAB3, and a compressor terminal TAB4. The active terminal TAB1 and the neutral terminal TAB3 are configured to connect respectively to an active terminal and neutral terminal of an AC outlet, which correspond to terminals of the alternating current (AC) source. In this embodiment, the heater terminal TAB2 and the compressor terminal TAB4 are configured to couple, respectively, to the heater and compressor of the refrigerator. In another embodiment, the heater terminal TAB2 may not be connected to anything for refrigerators without a heater for defrosting. Additionally, FIG. 2 show metal lines that connect terminals TAB1-TAB4 from the terminal unit 210 to the switching unit 300 and the DC supply unit 400.

The switching unit 300 may include an AC relay RY1, a photocoupler TR1 and a resistor R3. In the switching unit 300, a primary switching line 301 is provided between the active terminal TAB1 and the neutral terminal TAB3. In other word, the primary switching line 301 is connected to the active terminal TAB1 and the neutral terminal TAB3 in parallel. On the primary switching line 301, a coil part of the AC relay RY1 and a light reception part of the photocoupler TR1 are provided in series. In the switching unit 300, a secondary switching line 302 is provided between a DC source, which will be described further below, and the timer unit 500. On the secondary switching line 302, a light emission part of the photocoupler TR1 and the resistor R3 are provided in series.

The active terminal TAB1, the compressor terminal TAB4 and the heater terminal TAB2 are connected to a switching part of the AC relay RY1. In the AC relay RY1, the active terminal TAB1 is configured to connect to either of the compressor terminal TAB4 or the heater terminal TAB2. Thereby, the AC relay RY1 selectively couples the AC current source from the active terminal TAB1 to the compressor terminal TAB4 and the heater terminal TAB2. When the primary switching line 301 is off, the AC relay RY1 is configured such that the active terminal TAB1 and the compressor terminal TAB4 are connected.

For convenience, a line that connects the active terminal TAB1 and the switching part of the AC relay RY1 is called a first AC line 211. A line that connects the heater terminal TAB2 and the switching part of the AC relay RY1 is called a second AC line 212. A line that connects the neutral terminal TAB3 and the coil part of the AC relay RY1 is called a third AC line 213. A line that connects the compressor terminal TAB4 and the switching part of the AC relay RY1 is called a fourth AC line 214.

§1.2.2 DC Supply Unit 400

The defrost timer 100 includes the DC supply unit 400 to provide a DC current to the timer unit 500 and the switching unit 300. The DC supply unit 400 may include a varistor VR1, a capacitor C1, a resistor R1, a resistor R2, bridge diodes D1-D4, a zener diode D5, and an electrolytic capacitor C2.

The varistor VR1 is coupled to the active terminal TAB1 and the neutral terminal TAB3 in parallel. The varistor VR1 functions as a protective bypass.

The capacitor C1, the resistor R1 and the resistor R2 are coupled to the active terminal TAB1 in series. The resistor R1 is connected to the capacitor C1 in parallel and the resistor R2 is connected to the capacitor C1 in series. In the DC supply unit 400, the capacitor C1, the resistor R1 and the resistor R2 constitute a step down unit 401, which lowers AC voltage inputted from the active terminal TAB1 and the neutral terminal TAB3.

As shown in FIG. 2, one AC pin of the bridge diodes D1-D4 is coupled to the active terminal TAB1 through the step down unit 401. The other AC pin of the bridge diodes D1-D4 is connected to the neutral terminal TAB3. The plus pin of the bridge diodes D1-D4 is coupled to a voltage source (V+). The minus pin of the bridge diodes D1-D4 is coupled to a ground. The bridge diodes D1-D4 functions as a rectifier.

The zener diode D5 and the electrolytic capacitor C2 are coupled in parallel between the voltage source (V+) and the ground. In the DC supply unit 400, the zener diode D5 and the electrolytic capacitor C2 constitute a constant voltage unit 402, which provides a stable and constant voltage.

§1.2.3 Timer Unit 500

FIG. 3 illustrates a circuit diagram of the timer unit 500. The timer unit 500 may include a controller U1, a time input unit 510, a time display unit 520, a mode selection unit 530, an acceleration mode activation unit 540, and auxiliary connections 550. In this embodiment, the controller U1 is composed of, for example, a complementary metal oxide semiconductor (CMOS) integrated circuit (IC). Additionally, the controller U1 features three pins: P1, P3 and P4 for sending and receiving input and output signals. The controller U1 is coupled to all other units of the timer unit 500, including: the time input unit 510, the time display unit 520, the mode selection unit 530, the acceleration mode activation unit 540, and the auxiliary connections 550. The secondary switching line 302 from the switching unit 300 is also coupled to the controller U1. The controller U1 will be explained further below in more details.

The time input unit 510 allows a user to input a current time into the timer unit 500. The time input unit 510 may include a resistor R9, a resistor R17, a capacitor C4, a resistor R10 and a tactile switch S1. The tactile switch S1 is coupled to pin P3_4 of the controller U1.

The time display unit 520 displays a time inputted from the time input unit 510. The time display unit 520 features a light-emitting diode (LED) D6 and a resistor R8. The LED D6 is coupled to pin P1_7 of the controller U1.

As will be described further below, the defrost timer 100 has two modes of operations: 1) clock mode and 2) integration mode. The mode selection unit 530 sets the operational mode for the defrost timer 100. The mode selection unit 530 may include a resistor R13, a resistor R14 and a resistor R15. In the defrost timer 100, the resistor R15 is designed to be easily replaceable such that the operational mode of the defrost timer 100 is determined by the resistance value of the resistor R15. The mode selection unit 530 is coupled to pin P1_8 of the controller U1.

The acceleration mode activation unit 540 enables an accelerated cycle of operation performed by the controller U1. This allows manufacturers and repairers be able to quickly verify whether the defrost timer 100 and the refrigerator including the defrost timer 100 function properly. The acceleration mode activation unit 540 may include a resistor R11, a resistor R18, a capacitor C5, a resistor R12 and a jumper switch S2. The jumper switch S2 is coupled to pin P1_5 of the controller U1.

The auxiliary connections 550 provide and receive power, reference voltage, and data input/output to and from the controller U1. The auxiliary connections 550 contain a connector CN2, a resistor R4, a resistor R5, a resistor R6, a resistor R7, a capacitor C3, a resistor R16, and a capacitor C6. The controller U1 receives a DC voltage from the DC supply unit 400 at pin Vcc. The controller U1 receives a 0 V supply from the DC supply unit 400 via capacitor C3 at pin Vss. In addition, the controller U1 receives a reference voltage from the DC supply unit 400 at pin VREF. The controller U1 may transmit data from pin TXD1 to one of the connector CN2 pins, which can further be coupled to an electrical device outside of the defrost timer 100. The controller U1 may also receive data at its RXD1 pin from one of the connector CN2 pins. The controller U1 may receive a reset signal, which resets any process performed by the controller U1, at its RESET pin from one of the connector CN2 pins. The pin MODE of the controller U1 is also coupled to one of the connector CN2 pins.

Referring back to the FIG. 2, the secondary switching line 302 which is connected to the light emission part of the photocoupler TR1, is coupled to pin P1_1/AN9 of the controller U1. Thereby, the controller U1 is able to switch on and off the photocoupler TR1, which in turn switches on and off the AC relay RY1.

§1.3 Electrical Action of the Defrost Timer 100

In this section, with reference to the FIGS. 2-3, the electrical action of the defrost timer 100 is explained.

As explained above, an AC signal such as AC (120V) from the alternating current (AC) source is provided to the defrost timer 100 through the active terminal TAB1 and the neutral terminal TAB3. When the voltage of the AC signal is accidentally too high, the AC signal runs through the varistor VR1 to protect the timer unit 500. Then, the AC voltage is lowered to an acceptable level, for example 5V, through the step down unit 401. The AC signal is then rectified by the bridge diodes D1-D4. The current formed by rectifying the AC signal is flattened by the constant voltage unit 402. Therefore, a constant DC signal is provided to the timer unit 500 and the switching unit 300.

The timer unit 500 controls the switching unit 300 using the DC signal provided by the DC supply unit 400. Detailed operation of the timer unit 500 will be explained in a later section. In short, the controller U1 selectively turns on and off the current of the secondary switching line 302 according to an internal program. When the controller U1 turns off the secondary switching line 302, the primary switching line 301 is also off. In this embodiment, the first AC line 211 is selectively coupled to the fourth AC line 214 in the AC relay RY1. Thus, the provided AC signal runs from the active terminal TAB1 to the compressor terminal TAB4, which is coupled to the compressor of the refrigerator. On the other hand, when the controller U1 turns on the secondary switching line 302, the primary switching line 301 becomes on. In this embodiment, the first AC line 211 is selectively coupled to the second AC line 212 in the AC relay RY1. Thus, the provided AC signal runs from the active terminal TAB1 to the heater terminal TAB2, which is coupled to the heater of the refrigerator. While the primary switching line 301 is on, only a small AC current flows into the switching line 301 due to the high impedance of coil part of the AC relay RY1 (for example 1-10KΩ).

§1.4 Advantage of the Defrost Timer 100 on Circuit Design

The defrost timer 100 doesn't have a mechanical component that keeps moving. Therefore, it doesn't make a noticeable noise while running. Furthermore, it is durable and can last for over a decade.

In the defrost timer 100, AC signals are flowing into the coil part of the AC relay RY1. This means, the defrost timer 100 doesn't drive the relay by a DC current. In addition, the controller U1 is composed of a CMOS IC, which needs only a small amount of electric power. Therefore, the DC power needed in the defrost timer 100 is very small. This enables the capacitor C1, the resister R1 and the resister R2 to lower the AC voltage for generating DC voltage. In addition, this allows manufacturers to not use a transformer in the defrost timer 100 for lowering the AC voltage. Transformers are expensive electric parts that are large and heavy in terms of size and weight. Since the defrost timer 100 doesn't contain any transformer, the production cost of the defrost timer 100 is low. In addition, the defrost timer 100 is small and light, therefore easy to transport and handle. Furthermore, since the zener diode D5 is used to generate a constant DC voltage, and the zener diodes are relatively cheap compared to other elements with similar function, the production cost of the defrost timer 100 is lower.

§1.5 Part and Line Arrangement of the Defrost Timer 100

Figure 4:
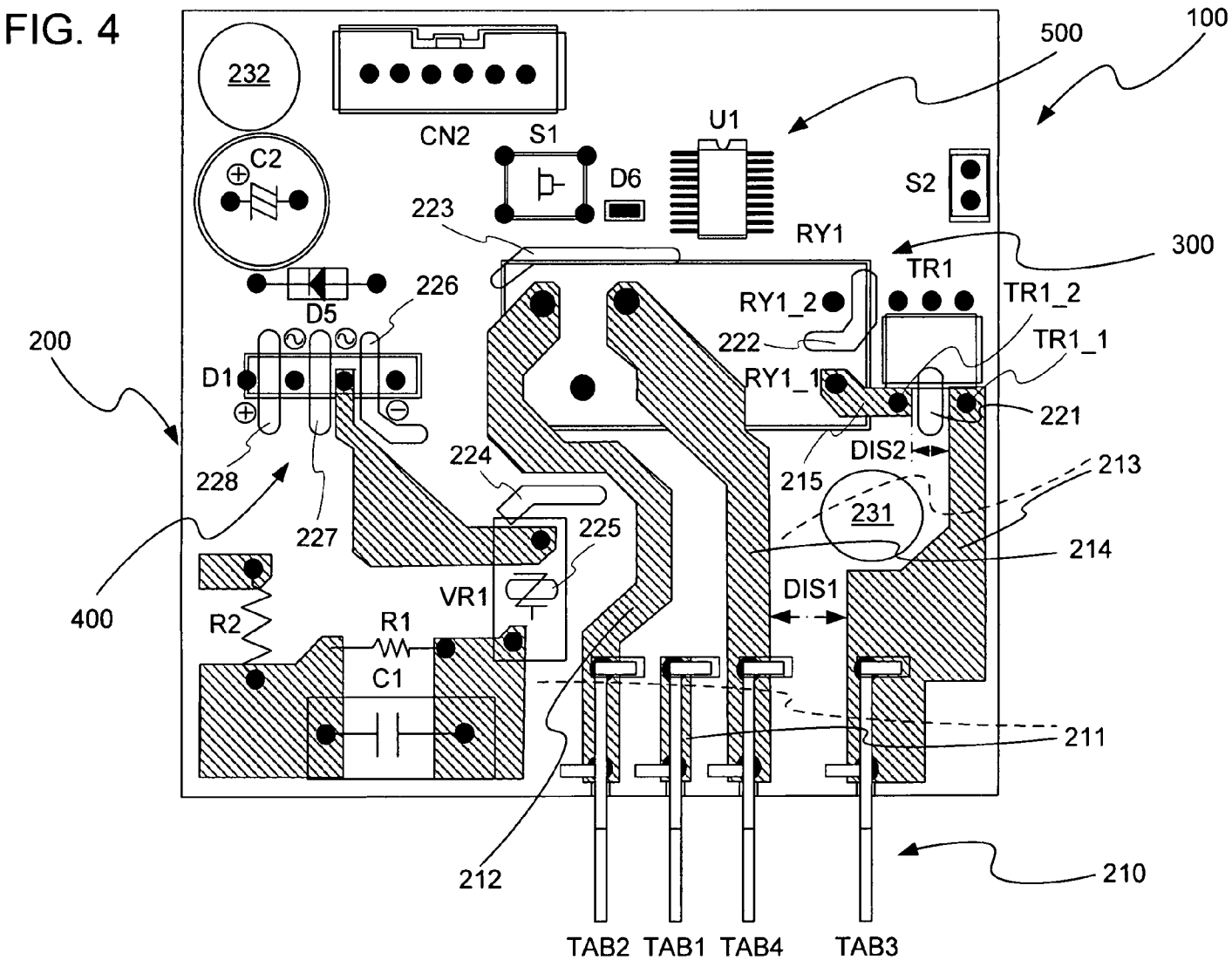
FIG. 4 illustrates a schematic plan view of a circuit board of a defrost timer.

Referring next to FIG. 4, a schematic plan view of the defrost timer 100 with different parts and lines arranged on the circuit board 200 are shown. For the sake of simplicity, drawings of some parts and lines are omitted. In this figure, AC lines are only shown with hatching. However, AC lines on the bottom side of the circuit board 200 are omitted. As shown in this figure and outlined in FIG. 1, an area provided for the terminal unit 210 and the switching unit 300 occupies at least one third of the entire area of the circuit board 200. Furthermore, an area provided for the terminal unit 210, the switching unit 300, and the DC supply unit 400 occupies at least a half of the entire area of the circuit board 200. Such arrangement makes it easy to design the circuit board 200 to effectively prevent the discharge of AC between different parts and lines.

On the circuit board 200, slits 221-228 and screw halls 231-232 are formed. The screw halls 231-232 are used to install the defrost timer 100 in or on the refrigerator using some screws.

As shown in FIG. 4, the first AC line 211, the second AC line 212, the third AC line 213 and the fourth AC line 214 are formed on the circuit board 200. In this embodiment, the distance between the third AC line 213 and the fourth AC line 214 (DIS1) is set to be at least 5 mm. This arrangement effectively prevents the discharge of AC signals between the third AC line 213 and the fourth AC line 214 even though a high voltage such as 120 V is provided between the two lines. For the same reason, it is preferable that the distance between the third AC line 213 and the first AC line 211 and the distance between the third AC line 213 and the second AC line 212 are set to be also at least 5 mm. It is also preferable that the distance between the neutral terminal TAB3 and the compressor terminal TAB4 is set to be at least 5 mm. Furthermore, it is also preferable that the distance between the neutral terminal TAB3 and the active terminal TAB1 and the distance between the neutral terminal TAB3 and the heater terminal TAB2 are also set to be at least 5 mm. Although not limited, the maximum distance between these lines and terminals may be set to 5 cm.

In this embodiment, the AC relay RY1 is provided approximately at the center of the circuit board 200. Such arrangement makes it easier to handle the defrost timer 100. Since the AC relay RY1 is relatively larger and heavier than the other parts used in the defrost timer 100, the gravity point of the defrost timer 100 becomes closer to the center of the circuit board 200 if the AC relay RY1 is located near the center of the circuit board 200. This makes the defrost timer 100 less prone to accidentally flip over while it is being put, for example, on top of the refrigerator while a worker is trying to install the defrost timer 100 into the refrigerator. One indicator of the 'approximately center' is that at least a part of the AC relay RY1 is between one quarter and three quarter in width of the circuit board 200 and between one quarter and three quarter in length of the circuit board 200. Furthermore, it is preferable that the AC relay RY1 is placed so that at least a part of the AC relay RY1 is placed between one third and two third in width of the circuit board 200 and between one third and two third in length of the circuit board 200.

The photocoupler TR1 is located adjacent to the AC relay RY1. This arrangement enables the AC lines on the circuit board 200 not to be excessively long. This makes it easy to design the circuit board 200 to effectively prevent the discharge of AC signals between the lines. One indicator of the 'adjacent to' is that the distance between the photocoupler TR1 and the AC relay RY1 is at most 2.5 cm. Furthermore, it is preferable that the distance between the photocoupler TR1 and the AC relay RY1 is within 1 cm. Although not limited, the minimum distance between the photocoupler TR1 and the AC relay RY1 can be set to 1 mm.

As shown in FIG. 4, the photocoupler TR1 contains five pins. Among these pins, the AC signal is inputted into the pins TR1_1 and TR1_2. The pin TR1_1 is coupled to the third AC line 213. The pin TR1_2 is connected to a line that couples the photocoupler TR1 and the AC relay RY1 in series (AC line 215). In this embodiment, a first slit 221 between the pins TR1_1 and TR1_2, is provided on the circuit board 200. This effectively prevents the discharge of AC signals between the pins TR1_1 and TR1_2. In this respect, it is preferable that the width of the slit 221 is at least 0.5 mm. Existence of the slit 221 allows the distance between the third AC line 213 and the AC line 215 (DIS2) to be set close to each other. Therefore, in this embodiment, the distance DIS2 is smaller than the distance DIS1. This enables an smaller area in which the switching unit 300 occupies the circuit board 200 and thus it allows the defrost timer 100 to be more compact. It is still preferable that the distance DIS2 is at least 1 mm. This effectively prevents the discharge of AC signals between the third AC line 213 and the AC line 215. Although not limited, the maximum width of the slit 221 and the maximum distance (DIS2) may be set to 1 cm.

The second slit 222 is provided between two pins RY1_1 and RY1_2 of the AC relay RY1 and between the pin RY1_2 and one pin of the photocoupler TR1, which is on the secondary switching line 302. The second slit 222 effectively prevents the discharge of AC signals between pins RY1_1 and RY1_2 and between the primary switching line 301 and the secondary switching line 302. The third slit 223 is provided between the AC relay RY1 and the timer unit 500, which effectively prevents the discharge of AC signals between them. The fourth slit 224, the fifth slit 225, the sixth slit 226, the seventh slit 227 and the eighth slit 228 are also provided on the circuit board 200. They also prevent the discharge of AC signals between some parts and metal lines. However, it is preferable that slits are not provided between the terminals TAB1-TAB4. This provides a mechanical strength to the circuit board 200. Therefore, the circuit board 200 is resistant to the breakage even when a plug is plugged in and out again and again to the terminals TAB1-TAB4.

On the circuit board 200, the LED D6 is provided adjacent to the tactile switch S1. This configuration brings an advantage which will be described later. One indicator of the 'adjacent to' is that the distance between the LED D6 and the tactile switch S1 is at most 2.5 cm.

§1.6 Miscellaneous Remarks

In the above exemplary embodiments, the distance between the first AC line 213 and the second AC line 214 (DIS1) was at least 5 mm. In other embodiments this distance may be smaller than 5 mm. Furthermore, in an alternative embodiment the distance DIS1 may even be smaller than the distance DIS2. In yet another embodiment, the distance DIS2 may be smaller than 1 mm while width of the slit 221 is smaller than 0.5 mm.

In addition, in the above exemplary embodiments, the AC relay RY1 is located approximately at the center of the circuit board 200. Other embodiments may place the AC relay RY1 near the edge of the circuit board 200. Moreover in the above exemplary embodiments, the photocoupler TR1 is adjacent to the AC relay TR1. However, in an alternative embodiment the photocoupler TR1 may be placed apart from the AC relay TR1.

In the above exemplary embodiments, the capacitor C1, the resistor R1 and the resistor R2, the step down unit 401, are coupled in series to the active terminal TAB1. The step down unit 401 may also be coupled in series to the neutral terminal TAB3 in other embodiments.

In addition, the step down unit 401 of the exemplary embodiment is constituted of the capacitor C1, the resistor R1 and the resistor R2. In alternative embodiments, the step down unit 401 may be constituted of only a capacitor or a resistor. In yet other embodiments, the step down unit 401 may be constituted of other parts such as a coil or a transformer.

Furthermore, the constant voltage unit 402 of the exemplary embodiment includes the zener diode D5 and the electrolytic capacitor C2. In other embodiments, the constant voltage unit 402 may include other part such as a 3-terminals regulator.

Moreover, in the above exemplary embodiments, the AC relay RY1 is driven by an AC signal. The AC relay RY1 may be replaced by a DC relay in other embodiments such that the DC relay is driven by a DC signal. Furthermore, in the above embodiments, the AC relay RY1 and the photocoupler TR1 are coupled to switch on and off the current into the compressor of the refrigerator. Alternative embodiments may use different elements, other than the relay and the photocoupler, for switching on and off the current into the compressor as a part of the switching unit 300.

In the above embodiment, all the electrical parts of the terminal unit 210, the switching unit 300, the DC supply unit 400 and the timer unit 500 are placed on the circuit board 200. In yet other alternative embodiments some essential parts of the defrost timer 100 may be placed on a different circuit board or in some other part of the refrigerator.

In the above embodiment, an AC signal 120V is supplied to the defrost timer 100. Other AC signals such as AC 100V, 220V or any other AC voltage may also be supplied to the defrost timer 100. Some embodiments may even supply a DC voltage to the defrost timer 100.

Additionally, the defrost timer 100 may include partially some mechanical components as well.

§1.7 Architecture of the Controller U1

Figure 5:
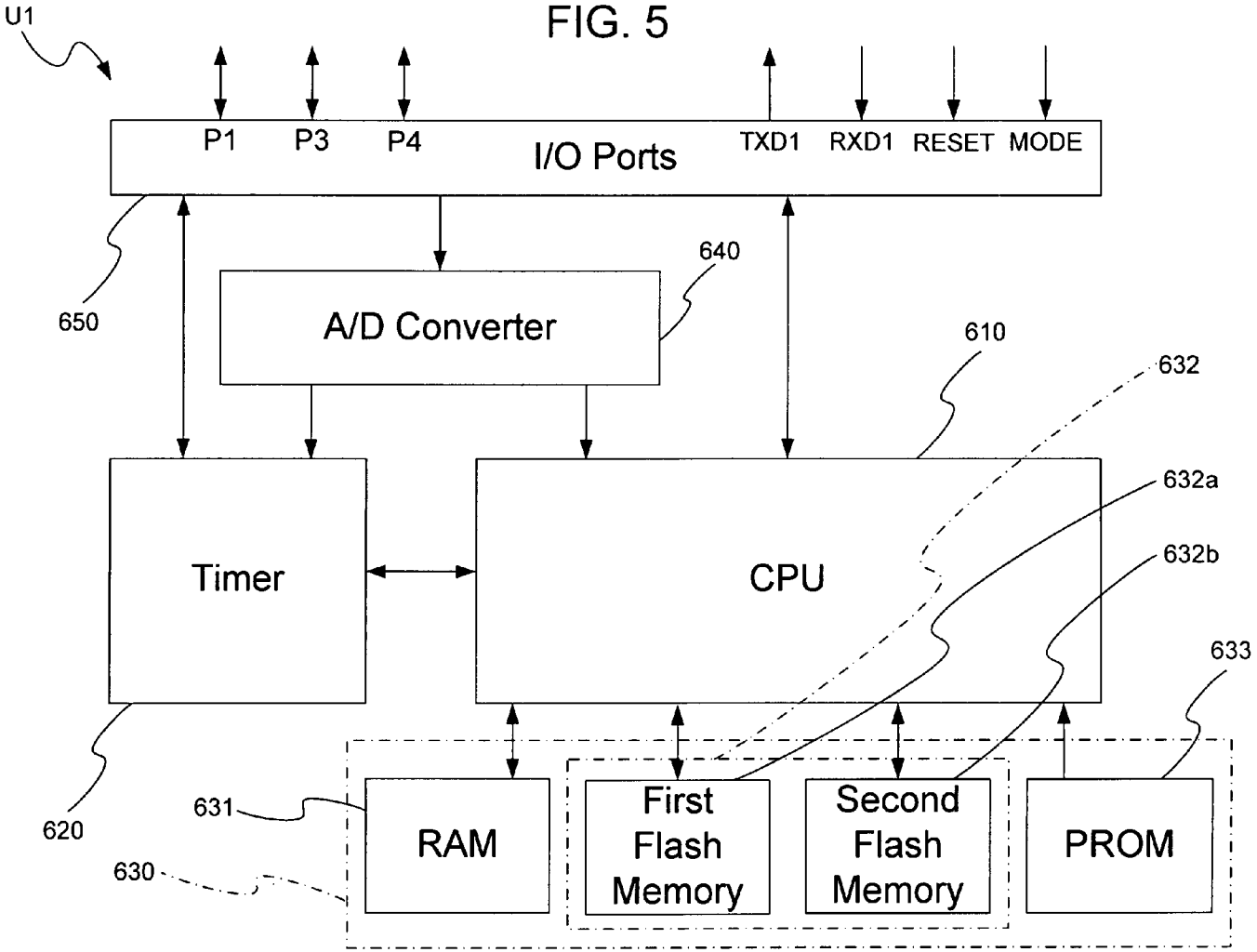
FIG. 5 depicts a block diagram displaying various components of a controller shown in FIG. 3.

As described before, the controller U1 of the timer unit 500 switches on and off the connection to the compressor and the heater of the refrigerator. With reference to FIG. 5, a block diagram of input/output connections between various components of the controller U1 and input/output connections between inside and outside of the controller U1 are shown. As shown in this figure, the controller U1 may include a central processing unit (CPU) 610, a timer 620, a memory 630, an analog/digital (A/D) converter 640, and input/output (I/O) ports 650. The memory 630 has a random access memory (RAM) 631, flash memories 632, and a program read only memory (PROM) 633. The flash memories 632 have two sets of flash memories; a first flash memory 632*a* and a second flash memory 632*b*.

The timer 620 counts a time and transmits the counted time to the CPU 610. The CPU 610, which runs programs stored in the PROM 633, outputs and stores temporary data in the RAM 631. The CPU 610 outputs and stores data, which are designed to retain even during a power failure, into the first flash memory 632*a* or the second flash memory 632*b*. According to the programs stored in the PROM 633 and the time counted by the timer 620, the CPU 610 outputs signals to the I/O ports 650 to control the switching unit 300 or to control the time display unit 520. Some signals from outside of the controller U1 are transmitted to the CPU 610 through the I/O ports 650 or through the I/O ports 650 and the A/D converter 640. Examples of such signals may include inputs from the time input unit 510 and the acceleration mode activation unit 540 and signals from the mode selection unit 530 and the auxiliary connections 550.

§1.8 Operation of the Controller U1

As described before, the CPU 610 runs programs stored in the PROM 633. The defrost timer 100 has two modes of operations: 1) a first mode of operation which is suitable for a refrigerator without a heater to defrost its evaporator, and 2) a second mode of operation which is suitable for a refrigerator with a heater to defrost its evaporator. When the defrost timer 100 is set to operate in the first mode, the CPU 610 runs a first program which will be described further below and is written in the PROM 633. When the defrost timer 100 is set to operate in the second mode, the CPU 610 runs a second program which will be described later and is also written in the PROM 633. As explained previously, either of these two modes are selected by replacing the resistor R15 in the mode selection unit 530. According to the resistance value of the resistor R15, two kinds of signals, for example a high signal or a low signal, may enter the pin P1_0/AN8 of the controller U1 from the mode selection unit 530. In the case where a high signal is inputted into the controller U1 from the mode selection unit 530, the CPU 610 runs the first program. On the other hand, in the case where a low signal is inputted into the controller U1 from the mode selection unit 530, the CPU 610 runs the second program.

§1.8.1 Overview of the First Program

Figure 6:
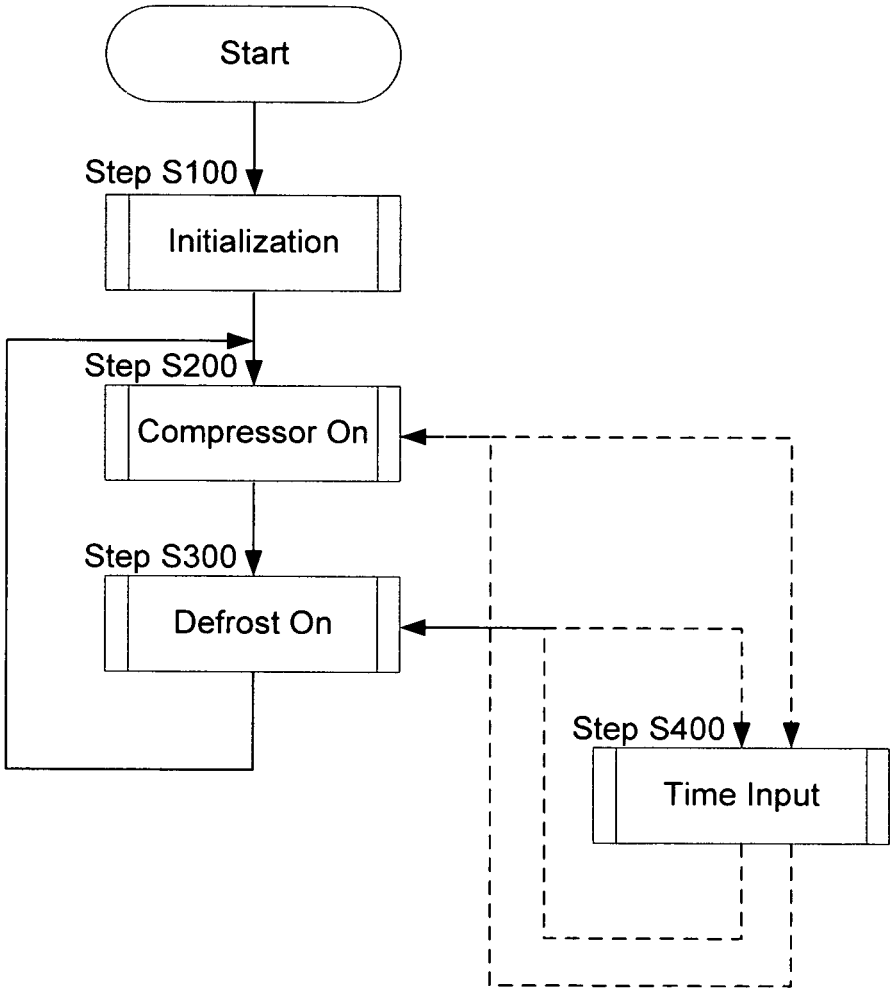
FIG. 6 illustrates a flowchart describing an overview of operational steps for a defrost timer.
Figure 7:
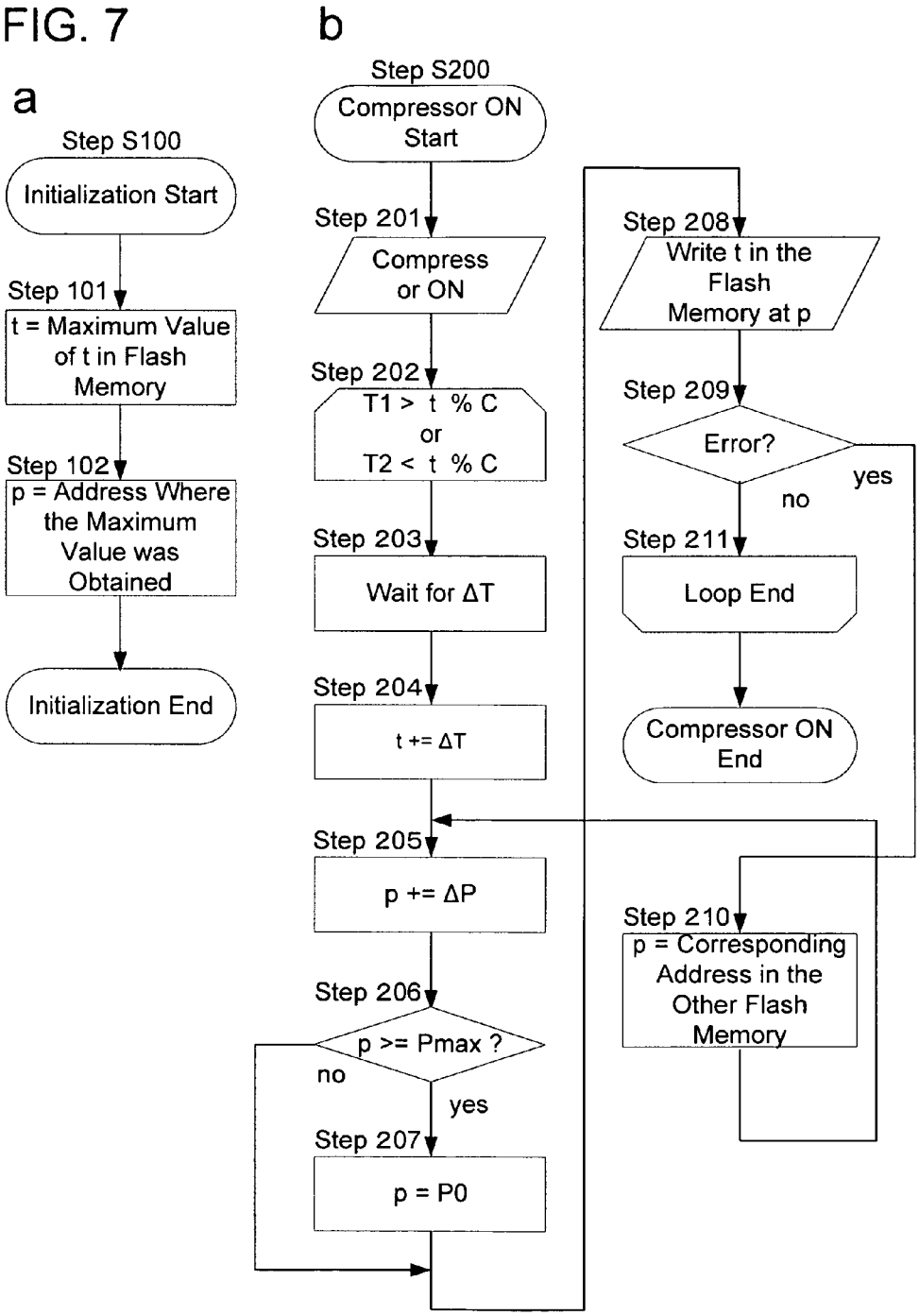
FIG. 7 illustrates a flowchart describing in detail the operational steps outlined in FIG. 6.
Figure 8:
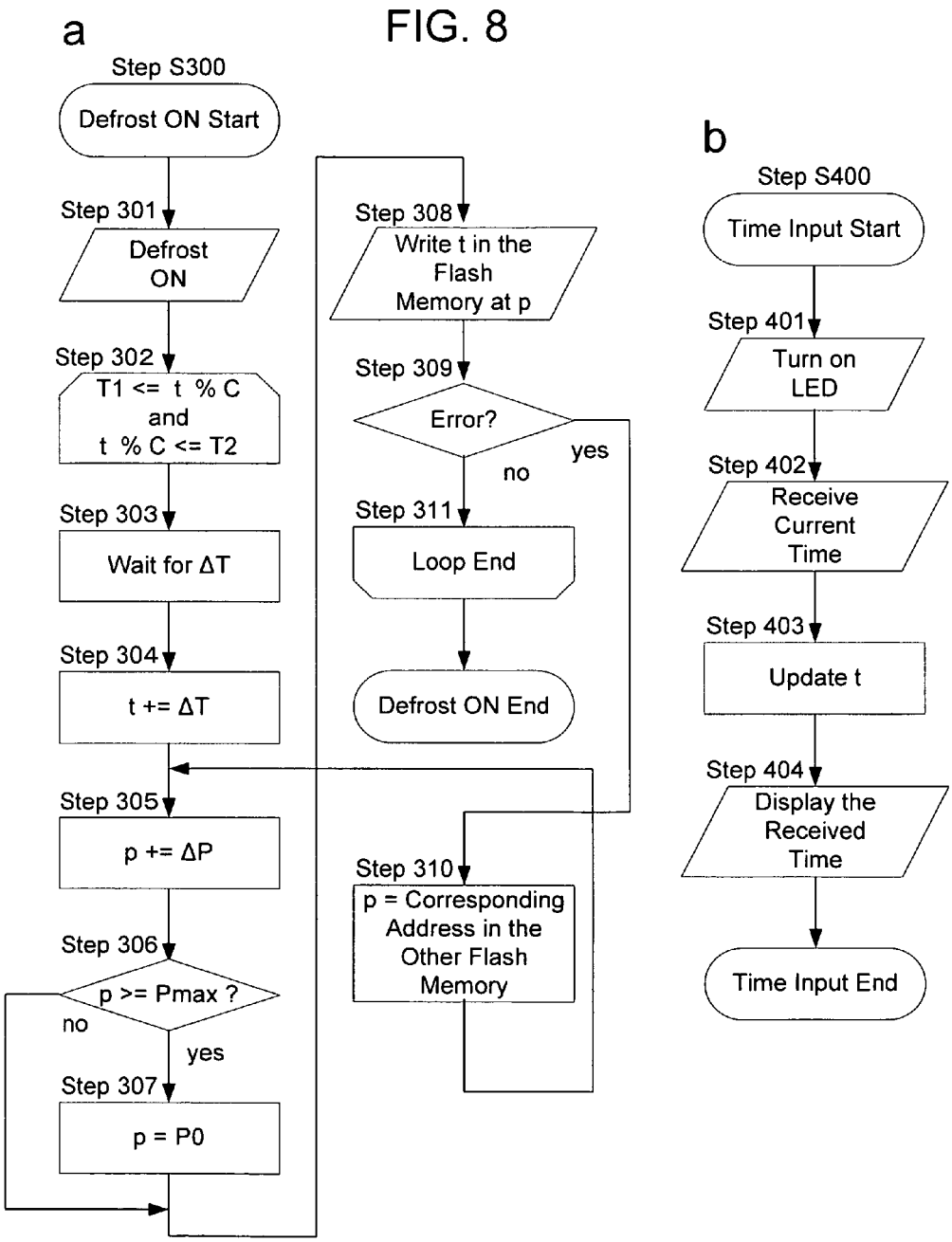
FIG. 8 illustrates a flowchart describing in detail the operational steps outlined in FIG. 6.

FIGS. 6-8 illustrate flowcharts describing operational steps of the defrost timer 100 that are mainly run by the CPU 610. In this specification, 24-hour system, which begins at 0:00 and ends at 24:00 hours, is used to indicate the time. In what follows, the overview of operational steps for the first mode of operation will be explained using FIG. 6. The first mode of operation is designed such that the defrost timer 100 initiates its defrosting period at a certain time every day. For example, by running the first program, the defrost timer 100 turns on the compressor of its refrigerator from 0:00 to 1:00 o'clock and from 4:00 to 24:00 o'clock. Then, the defrost timer 100 turns off the compressor from 1:00 to 4:00 o'clock, during which the defrosting mode is performed. As shown in FIG. 6, the first program is composed of four steps: 1) an initialization step S100, 2) a compressor-on step S200, 3) a defrost-on step S300, and 4) a time input step S400. Each of these steps is further divided into more detailed steps, which will be explained further below.

The initialization step S100 is executed when an AC power begins to be supplied into the defrost timer 100, for example after a power failure. In this step, the CPU 610 retrieves data, related to the time counted by the timer 620, from the flash memories 632 before the power is turned off.

In the compressor-on step S200, the CPU 610 maintains the compressor in the On position. During this step, the CPU 610 writes periodically, e.g. every five minutes, data related to the time counted by the timer 620 into the flash memories 632.

When the time counted reaches a predetermined time, for example 1:00 o'clock, the CPU 610 begins the defrost-on step S300. In this step, the CPU 610 turns off the compressor of its refrigerator for a certain period of time, for example three hours. Thereby, defrosting an evaporator of the refrigerator is achieved. Once the time counted reaches a certain time, for example 4:00 o'clock, the CPU 610 finishes the defrosting step and initiates again the compressor-on step S200. During the defrost-on step S300, the CPU 610 also writes periodically data related to the time counted by the timer 620 into the flash memories 632.

At any time during the compressor-on step S200 and the defrost-on step S300, the CPU 610 accepts an input about current time from a user. When the user pushes the tactile switch S1 (see FIG. 4), the CPU 610 initiates an interruption process, which is represented by the time input step S400. During this step, the CPU 610 receives and updates information related to the current time and uses this information for further time counting.

§1.8.2 The First Program

In this section, the first program will be explained in more detail, using FIGS. 7-8. In the first program, it is assumed that the AC power entered into the defrost timer 100 is off until the initialization step S100 is executed.

<<Initialization Step S100>>

As shown in FIG. 7*a*, the initialization step S100 is composed of two steps: Steps 101-102.

Figure 9:
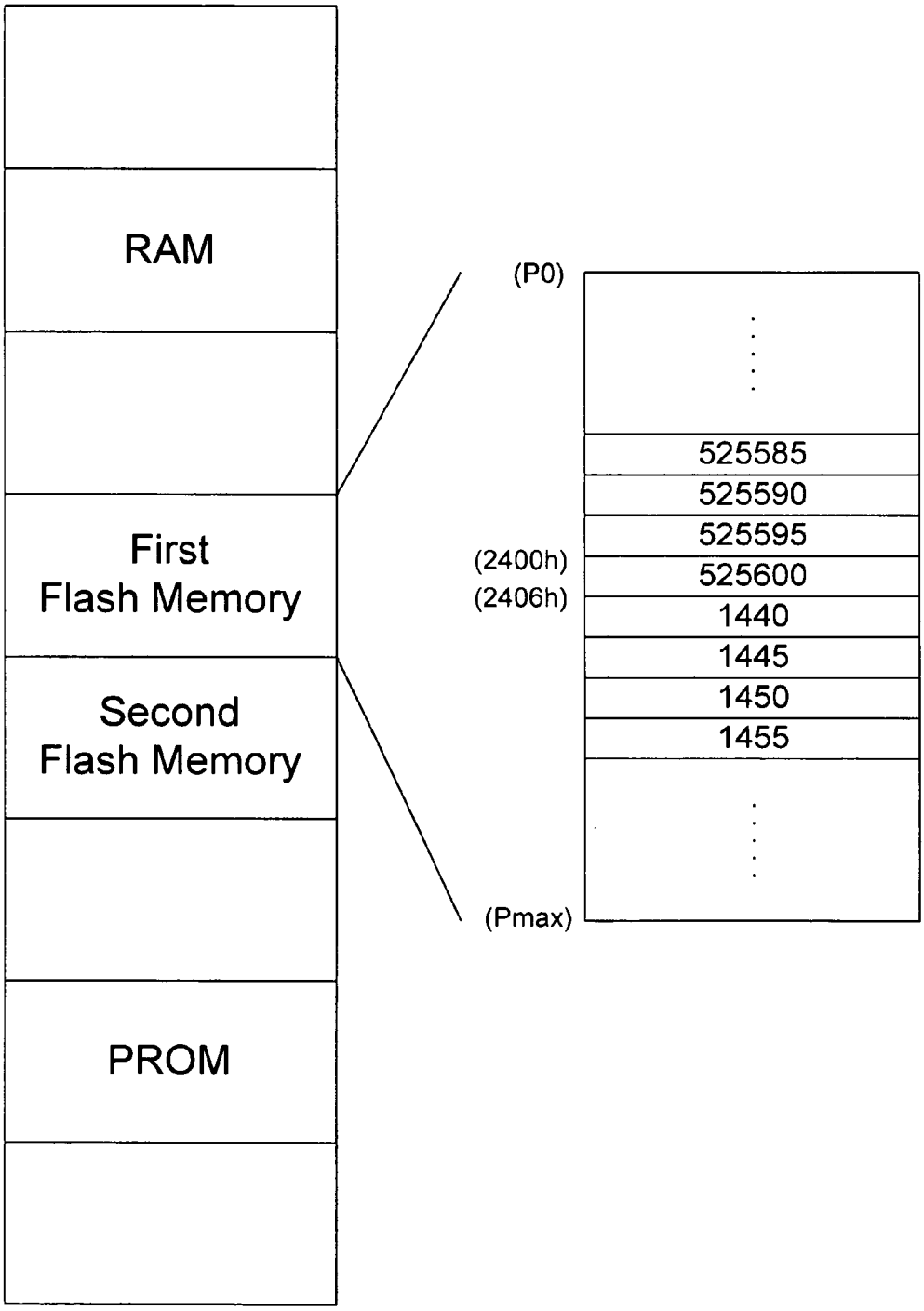
FIG. 9 depicts a schematic memory map of the memory unit shown in FIG. 5.

<Step 101>: Once the power is on, the CPU 610 seeks the maximum value of the time counted by the timer 620 from the flash memories 632 before the power is turned off. The CPU 610 stores this maximum value as a value 't' in the RAM 631. For example, as shown in FIG. 9, the CPU 610 seeks the maximum value stored in the flash memories 632, and retrieves the value '525600' from the flash memories 632 and stores this value as the value 't' in the RAM 631. The value 't' represents the time in minutes counted by the timer 620 until the power entered into the defrost timer 100 is turned off for the last time.

<Step 102>: The CPU 610 also obtains an address 'p' where the maximum value was stored in the flash memories 632. The CPU 610 stores also the value 'p' in the RAM 631. In the embodiment of FIG. 9, the maximum value is stored in the first flash memory 632*a* at the address '2400h'. Thus, the CPU 610 obtains the value '2400h' and stores this value as the address 'p'.

<<Compressor-on Step S200>>

As shown in FIG. 7*b*, the compressor-on step S200 is composed of eleven steps, Steps 201-211. In brief summary, the CPU 610 first turns on the compressor of the refrigerator (Step 201). While the counted time 't' is below a preset time 'T1' or above a preset time 'T2', the CPU 610 keeps performing the following processes: Steps 202-211. According to the time counted by the timer 620, the CPU 610 writes a value 't' at an address 'p' in the flash memories 632 with an interval ΔT (Steps 203, 204 & 208). At this time, the CPU 610 tries to writes the value 't' at a different address where the value 't' is written for last time in the same flash memory 632*a* or 632*b* (Steps 205-208). If a writing error occurs, the CPU 610 writes the value t in a different flash memory 632*a* or 632*b* (Steps 209 & 210). When the value 't' reaches the preset value 'T1', the process proceeds to the defrost-on step S300.

<Step 201>: The CPU 610 turns on the line to the compressor. This is done by turning off the secondary switching line 302, leading the first AC line 211 and the fourth AC line 214 to be connected and the first AC line 211 and the second AC line 212 to be disconnected at the AC relay TR1.

<Step 202>: The CPU 610 determines whether a remainder of the value 't' divided by a cycle length 'C' is below the preset time 'T1' or above the preset time 'T2'. In the case where the above mentioned condition is satisfied, the process proceeds to Step 203. In the case where the above mentioned condition is not satisfied, the process terminates the compressor-on step S200. The cycle length 'C' in this embodiment is the length of a day in minutes, which is 24×60=1440. The remainder of the value T divided by the cycle length 'C' gives a value of time in minutes on the day in which the defrost timer 100 is running. The preset time 'T1', in this embodiment, is a predetermined threshold value corresponding to a time when the defrosting process is supposed to initiate. In the same way, the preset time 'T2' is a value corresponding to a time when the defrosting process is supposed to terminate. As an example, in the case where the defrosting process starts at 1:00 o'clock and finishes at 4:00 o'clock, the preset time 'T1' is 1×60=60 while the preset time 'T2' is 4×60=240.

<Step 203>: The CPU 610 waits for a certain period of time 'ΔT', for example 5 minutes, which refers to a time counted by the timer 620.

<Step 204>: The CPU 610 increases the value T by the value 'ΔT'. For example, the CPU 610 increases the value 't' to '525605' if the value t is set to '525600'.

<Step 205>: The CPU 610 increases the address p by a record size (or a cell size of the flash memory 632) 'ΔP'. For example, in the case where the record size 'ΔP' is 6 bytes, the CPU 610 increases the address 'p' to '2406h' if the address 'p' is set to '2400h'.

<Step 206>: The CPU 610 determines whether the address 'p' is the same or above a limit address of flash memory 'Pmax'. In the case where the above condition is satisfied, the process proceeds to Step 207. If not, the process jumps to Step 208.

<Step 207>: The CPU 610 sets a start address of flash memory 'P0' as the address 'p'.

<Step 208>: The CPU 610 writes the value 't' in the flash memory 632 at the address 'p'. For example, if the value 't' is '5256005' and the address 'p' is '2406h', the CPU 610 writes the value '5256005' at the address '2406h' in the flash memory 632.

<Step 209>: The CPU 610 determines whether a writing error occurred in the previous steps. If the writing error occurred, the process jumps to Step 210. If the writing error did not occur, the process proceeds to Step 211.

<Step 210>: The CPU 610 sets the corresponding address of the address 'p' in the other flash memory 632 as a new address 'p'. For example, if a writing error occurs at an address '2406h' in the first flash memory 632*a*, the CPU 610 sets the address corresponding to '2406h' in the second flash memory 632*b* as the address 'p'. Then, the process jumps back to Step 205.

<Step 211>: The process goes back to Step 202.

<<Defrost-on Step S300>>

As shown in FIG. 8*a*, the defrost-on step S300 is composed of eleven steps: Steps 301-311. Briefly, the CPU 610 first turns off the compressor of the refrigerator (Step 301). While the counted time 't' is the same or above the preset time 'T1' and the same or below the preset time 'T2' (Step 302), the CPU 610 keeps performing the same process as described in the compressor-on step S200 (Steps 303-311).

<Step 301>: The CPU 610 turns off the line to the compressor. This is performed by turning on the secondary switching line 302, leading the first AC line 211 and the second AC line 212 to be connected and the first AC line 211 and the fourth AC line 214 to be disconnected at the AC relay TR1.

<Step 302>: The CPU 610 determines whether a remainder of the value 't' divided by the cycle length 'C' is the same or above the preset time 'T1' and the same or below the preset time 'T2'. If yes, the process proceeds to Step 303. If not, the process terminates the defrost-on step S300.

<Steps 303-311>: Since these steps are the same as steps: Steps 203-211, explained above, their explanations are omitted.

<<Time Input Step S400>>

This step is initiated as an interruption process when the tactile switch S1 is pressed for a certain period of time, for example three seconds, during the Step 203 or the Step 303. The signal from the tactile switch S1 enters the pin P1_0/AN8 of the controller U1 through the time input unit 510. As shown in FIG. 8*b*, the time input step S400 is composed of four steps: Steps 401-404.

<Step 401>: First, the CPU 610 turns on the LED D6 for a short period of time, for example 10 seconds, by outputting a signal from the pin P1_7 of the controller U1. This notifies a user that the user may presently input the current time.

<Step 402>: While the LED D6 is on, the user inputs the current time by pressing the tactile switch 51 according to a switch pushing times parameter, defined in Table 1. For example, when the current time is 16:37, the user pushes the tactile switch S1 8 times. Thereby, the CPU 610 receives an input related to the current time. If the number of times the tactile switch S1 is pressed is not proper, the CPU 610 doesn't perform the following steps and terminates the time input step S400, thereby turning off the LED D6.

<Step 403>: according to the current time inputted from the tactile switch S1, the CPU 610 updates the value 't' in the flash memories 632 so that the value 't' reflects the inputted time, which is larger than the previous value of 't'. For example, the value T may be updated by the following equation: $t=((t/1440)+1)\times1440+Tin\times60$ where 'Tin' is the inputted time, which refers to the setting time parameter, defined according to the Table 1. In this equation, the remainder of the division is rounded off.

<Step 404>: The CPU 610 blinks the LED D6 based on the number of times the tactile switch S1 is pressed at the Step 402. This blinking process enables the user to confirm whether his/her intended time is inputted properly.

When the time input step S400 is finished, the process goes back to the original step, where the CPU 610 was executing before initiating the time input step S400. For example, if the CPU 610 was performing the Step 203 before the time input step S400, the process goes back to the Step 203.

If the time the user inputted does not correspond to the time the user intended to input, the user may push the tactile switch S1 for three seconds again. In this case, the time input step S400 begins initiating and the user may input the intended current time again.

§1.8.3 Advantage of the First Program

As described above, in the first program, the CPU 610 receives an input related to the current time through the time input unit 510, and the CPU 610 adjusts the value 't' based on this input. This program enables the CPU 610 to initiate the defrosting cycle at a certain time more accurately. In fact, although the controller U1 counts the time internally, this counted time may be shifted by hours due to a power failure. Thus, the defrost timer 100 pertaining to the present invention allows the CPU 610 to adjust the initiating time of its defrosting cycle accordingly. This feature enables the CPU 610 to perform the defrosting cycle at a specific time frame, for example from 1:00 o'clock to 4:00 o'clock every day, with an increased accuracy.

In addition, the CPU 610 writes the value 't', which reflects the time counted by the timer 620 into the flash memories 632. This value is retained even while the power to the defrost timer 100 is failed. Therefore, the time counting resumes from the time when the power failure is occurred. If the power failure is short, the time counted is not behind much. Therefore, the CPU 610 may still perform its defrosting cycle at a pretty accurate time.

Besides, the CPU 610 writes periodically the value 't' into the flash memories 632. This may increase the longevity of the flash memories 632. The flash memories 632 may write data only a limited number of times. By writing data into the flash memories 632 with a certain interval time 'ΔT', the defrost timer 100 may reduce the number of times where data is written into the flash memories 632. This elongates the longevity of the flash memories 632.

In this respect, in this embodiment, the interval time 'ΔT' is set to 5 minutes. It should be noted that the interval time 'ΔT' is not limited to this length. However, it is preferable that the interval time 'ΔT' is set to at least 2 minutes. According to the inventor's calculation, this length enables to keep rewriting in the flash memories 632 for a long period of time such as over a decade. Although not limited, the maximum interval time 'ΔT' may be also set to 2 hours.

Furthermore, in the above Example, the CPU 610 writes the value T at an address 'p' of the flash memories 632, which is different from the address 'p' where the value 't' was written for the last time. This avoids writing data repeatedly in the same cell of the flash memories 632. This feature further enhances the longevity of the flash memories 632. In this embodiment, the CPU 610 writes the value 't' into the flash memories 632 sequentially. In other embodiments, the CPU 610 may write in to the flash memories 632 randomly, in other word at a random address of the flash memories 632.

It is preferable that the controller U1 has at least 1 kilobyte of total size for the flash memories 632. According to the inventor's calculation, this size enables to keep rewriting the flash memories 632 for a long period of time such as over a decade. Although not limited, the maximum size may be set to 1 megabyte.

In this embodiment, the controller U1 includes two flash memories: the first flash memory 632*a* and the second flash memory 632*b*. This feature may prevent the breakage of the defrost timer 100 efficiently. Even in the case one of the flash memories 632 breaks, the defrost timer 100 may still keep running without any problem. Although in this embodiment, the defrost timer 100 includes two flash memories, other embodiments may include defrost timers 100 with more than two flash memories. On the contrary, in an alternative embodiment, the defrost timer 100 may use only one or not any flash memory.

Additionally, in this embodiment, the CPU 610 writes the value T into a same flash memories 632 as long as the same flash memory 632 allows the CPU 610 to rewrite its value. This feature may bring an easier coding scheme for a programmer. In addition, the debug of the program may also be easier.

As shown in Table 1, the number of times the tactile switch S1 is pressed by the user is always smaller than a numeral, e.g. the setting time parameter, represented by time in hour. For example, when the current time is '16:37', the setting time parameter is set to '16:00' and the numeral represented by time in hour is '16'. In this case, the number of times the tactile switch S1 may be pressed is set to '8', which is smaller than '16'. This makes it easier for the user to input the time as the maximum number of times to push the tactile switch S1 by the user is only 12 times. In other embodiment, if the numeral of the time is '0' represented in hour, the user may not have to push the tactile switch S1, meaning the number of times the tactile switch 51 is pressed is '0'.

§1.8.4 Overview of the Second Program

In what follows, the second program will be explained using the same FIGS. 6-8. It has to be noted that only matters different from those explained in the first program will be explained in this section. First, an overview of the operational step for the second mode will be explained, using FIG. 6. The second operational mode is designed such that the defrost timer 100 initiates its defrosting cycle after the compressor is on for a certain period of time. For example, by running the second program, the defrost timer 100 defrosts the evaporator of the refrigerator for 20 minutes after the compressor was on for about 10 hours. Then, the defrost timer 100 switches on the compressor again for another 10 hours. The second program is mainly composed of three steps, an initialization step S100, a compressor-on step S200 and a defrost-on step S300. Contrary to the first program, the time input step S400 is inactivated in this program. In other word, the second program does not allow a user to input his/her intended input time.

Similar to the first program, the initialization step S100 is executed when an AC power begins to be supplied to the defrost timer 100. However, the second program is designed to be used in a refrigerator that turns off the power to the defrost timer 100 while its compressor is off. In the initialization step S100, the CPU 610 retrieves a data from the flash memories 632 related to the time counted by the timer 620 before the power to the defrost timer 100 is turned off.

In the compressor-on step S200, the CPU 610 keeps the switch in a position where the line to the compressor is on. During this step, the CPU 610 writes periodically data related to the time counted by the timer 620 into the flash memories 632 as long as the power to the defrost timer 100 is on.

When the time counted reaches a predetermined threshold, for example 10 hours, the CPU 610 begins the defrost-on step S300. In this step, the CPU 610 turns off the compressor of the refrigerator and turns on the heater for its defrosting cycle for a specific period of time, for example 20 minutes. Thereby, defrosting of the evaporator is achieved. After the specific period of time, the CPU 610 finishes this step and initiates the compressor-on step S200 again. During this step, the CPU 610 also writes periodically data related to the time counted by the timer 620 into the flash memories 632. One remarkable feature of the second mode is that the defrost timer 100 is designed to be installed in a refrigerator so that the defrost timer 100 is connected to a switch, such as a thermostat, which turns on and off the compressor, in series. Thus, when this switch is off, the power supply to the defrost timer 100 is off as well as the power supply to the compressor is off. This means that the defrost timer 100 doesn't count any time while the compressor is off by other devices, e.g. the thermostat. In other word, the defrost timer 100 is configured so that the CPU 610 writes a value, which reflects the running time of the compressor into the flash memories 632, by taking into account the operation of other devices of the refrigerator, such as the thermostat, which controls the compressor.

§1.8.5 The Second Program

In this section, the second program will be explained in more detail, using FIGS. 7-8. As explained previously, only different matters from the first program will be explained.

<<Initialization Step S100>>

The initialization step S100 is the same explained in the first program.

<<Compressor-on Step S200>>

<Step 201>: This step is the same as the in the first program.

<Step 202>: In the second program, the values of the cycle length 'C', the preset time 'T1', and the preset time 'T2' are different from those set in the first program. The cycle length 'C' is the sum of the compressor-on time and the defrost-on time. For example, when the compressor is on for about 10 hours and the defrosting is on for 20 minutes, the cycle length 'C' is 10×60+20=620. The preset time 'T1' is defined as a value corresponding to the period of time when the compressor is on. In the case where the compressor is on for 10 hours, the preset time 'T1' is 10×60=600. The preset time 'T2' is defined as a value corresponding to the sum of period of time when the compressor and the defrosting cycle are on. In the case where the compressor is on for about 10 hours and defrosting is on for 20 minutes, the preset time 'T2' is 10×60+20=620.

<Step 203-211>: These steps are similar to those explained in the first program.

<<Defrost-on Step S300>>

<Step 301>: The CPU 610 turns off the line to the compressor while it turns on the line to the heater. This is performed by turning on the secondary switching line 302, leading the first AC line 211 and the second AC line 212 to be connected and the first AC line 211 and the fourth AC line 214 to be disconnected at the AC relay TR1.

<Steps 302-311>: These steps are similar to those explained in the first program.

§1.8.6 Advantage of the Second Program

As described above, in the second program, the CPU 610 is configured to write the value 't', which reflects a running time of the compressor, into the flash memories 632. Since the amount of frost and ice accumulated on the compressor correlates with the running time of the compressor, this configuration enables the defrost timer 100 to initiate its defrosting cycle before the amount of frost and ice becomes large. This leads to an efficient operation of the refrigerator.

Since other advantages of the second program will become more in the context of the refrigerator, such advantages will be explained in the following sections.

§1.8.7 Acceleration Mode

Referring back to FIG. 4, when the jumper switch S2 is closed, a signal from the acceleration mode activation unit 540 enters the pin P1_5 of the controller U1. In this case, cycles corresponding to the compressor-on step S200 and the defrost-on step S300 are performed with a shorter period of time. For example, in the first program, the cycle length 'C' becomes 24 minutes. In addition, the period during which the defrosting cycle is performed becomes 3 minutes by setting, respectively, the preset time 'T1' and 'T2' to the following values: 1 and 4. In the second program, the cycle length 'C' becomes 12 minutes. In addition, the period during which the defrosting cycle is performed, becomes 2 minutes by setting the preset time 'T1' and 'T2' to 10 and 12 values respectively. In each case, the interval 'ΔT' is set to 1 minutes. This enables manufacturers and repairers of refrigerators to verify easily whether the defrost timers 100 are working properly within their refrigerators.

§2 Refrigerator

In this section, refrigerators with the defrost timer 100 pertaining to the present invention will be described using FIGS. 10-13.

§2.1 Overview of the Refrigerator

Figure 10:
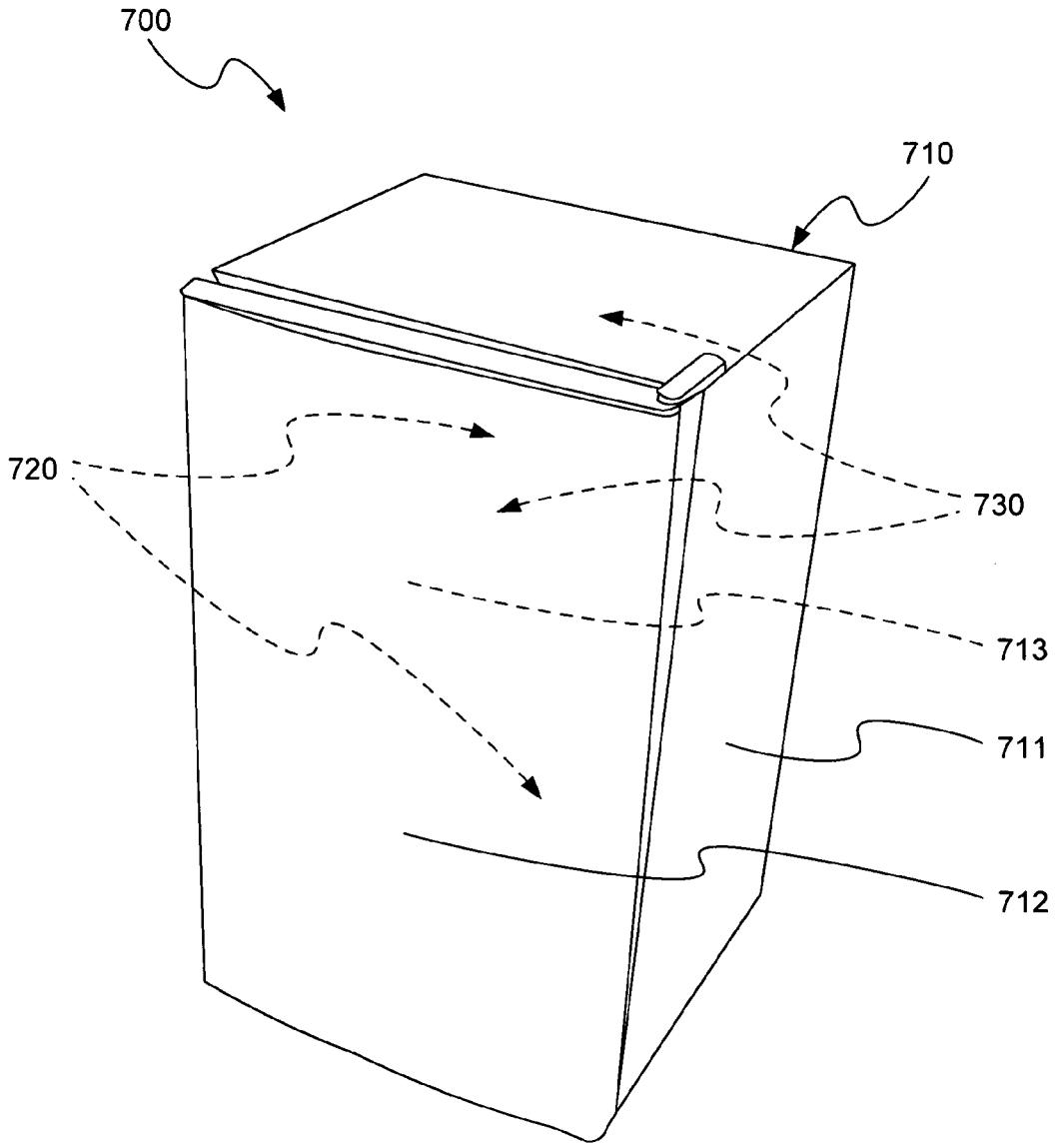
FIG. 10 represents a perspective view from upper front of an example of a refrigerator having a defrost timer pertaining to the present invention.

FIG. 10 shows a perspective view from the upper front of a refrigerator 700.

Figure 11:
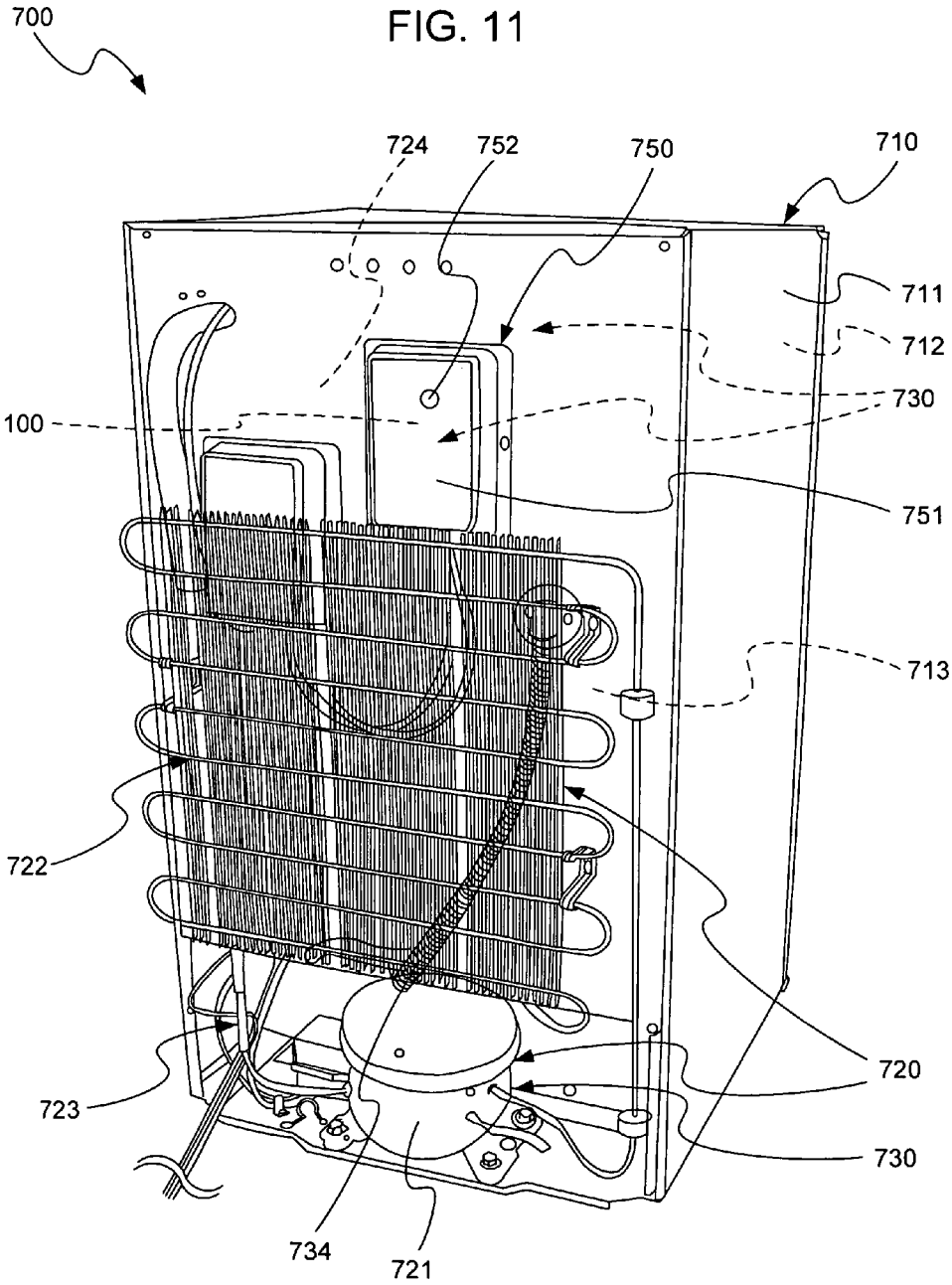
FIG. 11 represents a perspective view of the refrigerator shown in FIG. 10, viewed from behind the refrigerator.

FIG. 11 shows a view of the refrigerator 700 seen from behind. As shown in these figures, the refrigerator 700 may include a compartment system 710, a heat-exchange system 720, an electric system 730 and accessory parts 750.

The compartment system 710 has a housing 711, and a door 712. The door 712 is attached to the housing 711 so that it can be opened and closed. When the door 712 is closed, inside of the refrigerator 700 is insulated from outside. This inside insulated compartment is called refrigeration room 713.

The heat-exchange system 720 includes a compressor 721, a condenser 722, an accumulator 723, and an evaporator 724, each of which is connected to each other by a pipe. The heat-exchange system 720 may also have a coolant, which circulates internally. As shown in FIG. 11, the compressor 721, the condenser 722 and the accumulator 723 are placed outside of the compartment system 710, more specifically behind the housing 711. The evaporator 725 is placed inside of the compartment system 710.

In the refrigerator 700, the heated coolant is compressed by the compressor 721. This compressed coolant emits heat and is condensed in the condenser 722. The boiling point of the coolant is lowered by the function of the accumulator 723 in which its internal pressure is first elevated and then lowered. The condensed coolant evaporates in the evaporator 724. When the coolant evaporates, it takes heat around the evaporator 724. Thereby, the refrigeration room 713 is refrigerated. The heated coolant goes back to the compressor 721.

The accessory parts 750 contains a defrost timer cover 751, which includes a hole 752. As shown in FIG. 11, the defrost timer 100 is attached to the behind side of the refrigerator 700 by screws using the screw holes 231 and 232 (see FIG. 4). Then, the defrost timer 100 is covered by the defrost timer cover 751. The hole 752 is located above the tactile switch S1, or at the same position if seen perpendicularly from a sight facing to the defrost timer 100. Therefore, the user may press the tactile switch S1 through the hole 752. As described previously, the LED D6 is located near the tactile switch S1. Thus, the user may easily see and recognize the light from the LED D6 through the hole 752. Although not written in the figure, an instruction of how to adjust a time of the defrost timer 100 is given on the defrost timer cover 751 with a table similar to the Table 1. Therefore, the user may easily adjust the time of the defrost timer 100.

In one embodiment, the refrigerator 700 may include an electric system 730, hereinafter referred to as a first electric system 730*a*. In another embodiment, the refrigerator 700 may include another type of the electric system 730, hereinafter referred to as a second electric system 730*b*. In what follows, the first and second electric system 730*a* and 730*b* will be explained, respectively.

§2.2 First Electric System 730*a*

Figure 12:
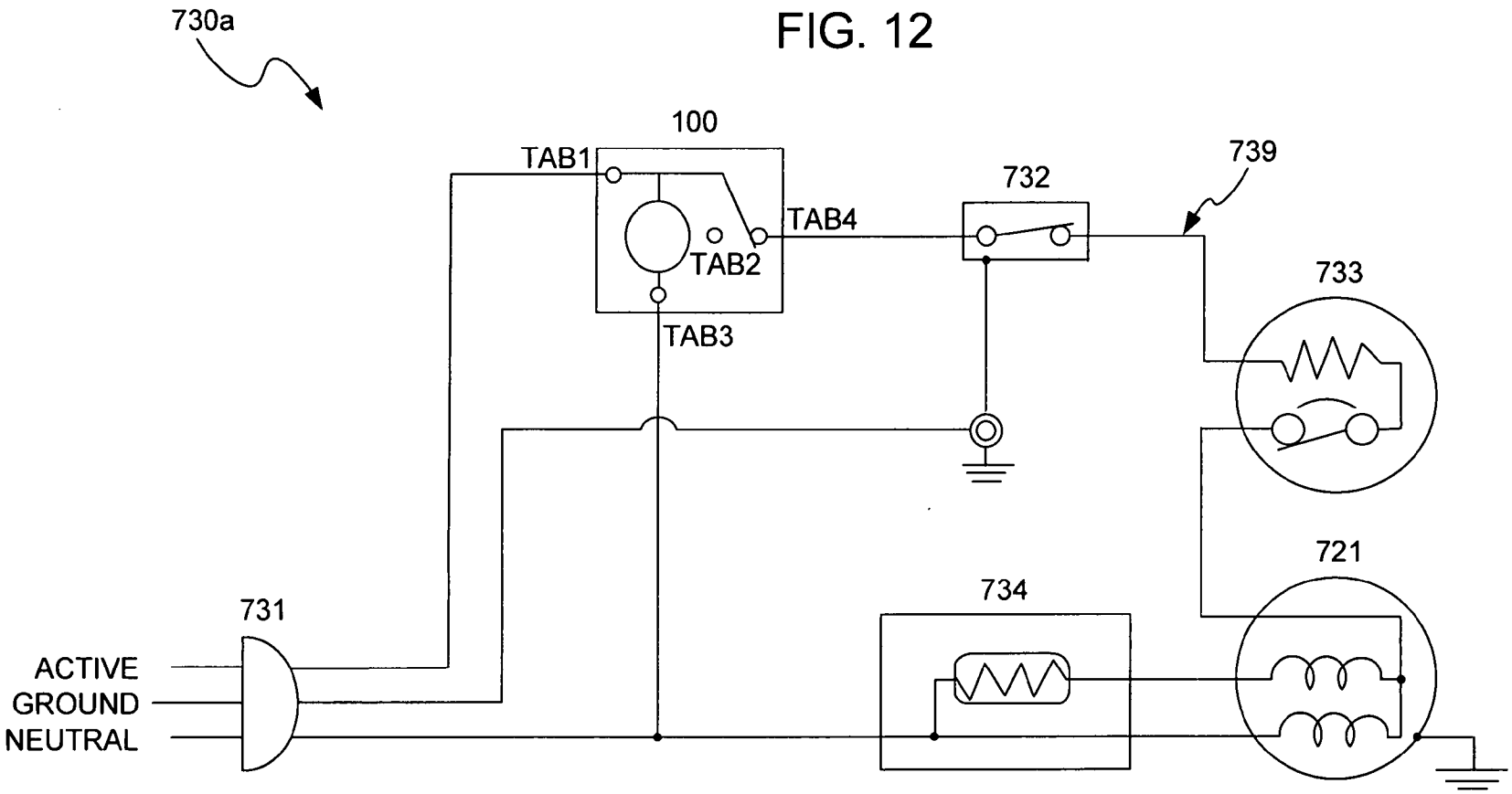
FIG. 12 depicts a schematic circuit diagram of an embodiment of connections between various electric parts of the refrigerator shown in FIG. 10.

FIG. 12 illustrates a schematic circuit diagram of the first electric system 730*a*. The refrigerator 700 having the first electric system 730*a* is often called a mechanical refrigerator or direct-cool refrigerator. This type of refrigerator is commonly used, for example, in hotel rooms. As shown in this figure, the first electric system 730*a* may include an AC plug 731, the defrost timer 100, a thermostat 732, an overload protector 733, the compressor 721 and a positive temperature coefficient (PTC) thermistor 734. Since the refrigerator 700 with the first electric system 730*a* doesn't contain a heater to defrost the evaporator 724, the first program is preferably used to defrost the evaporator 724.

In this embodiment, the AC plug 731 may include three terminals, an active terminal, a ground terminal, and a neutral terminal. The active terminal of the AC plug 731 is coupled to the active terminal TAB1 of the defrost timer 100. The neutral terminal TAB3 is coupled to the neutral terminal of the AC plug 731. In other word, the active terminal TAB1 and the neutral terminal TAB3 of the defrost timer 100 are connected to the AC plug 731 in parallel. Thus, the power is always provided to the DC supply unit 400 of the defrost timer 100. For convenience, the line which connects the compressor terminal TAB4 to the neutral terminal of the AC plug 731 is called a compressor line 739. The thermostat 732, the overload protector 733, the compressor 721 and the PTC thermistor 734 are provided on the compressor line 739. More specifically, the thermostat 732, the overload protector 733, and the compressor 721 are coupled in series to the compressor terminal TAB4 and the neutral terminal of the AC plug 731. The PTC thermistor 734 is coupled to a part of the compressor 721 in parallel. In the first electric system 730*a*, the heater terminal TAB2 is open, in other word is not connected to anything.

In the first electric system 730*a*, the thermostat 732 and the compressor 721 are coupled to the ground terminal of the AC plug 731.

The thermostat 732 is provided in the refrigeration room 713 to monitor the temperature of the refrigeration room 713. The PTC thermistor 734 is provided near the condenser 722 to monitor the temperature of the condenser 722.

While the defrost timer 100 selectively couples the active terminal TAB1 to the compressor terminal TAB4 at the AC relay RY1, in other words, when the defrost timer 100 executes the step of compressor-on step S200, an AC signal flows into the compressor line 739. In this way, the AC signal flows from the active terminal of the AC plug 731 through the active terminal TAB1, the AC relay RY1, the compressor terminal TAB4, the thermostat 732, the overload protector 733, the compressor 721, and the PTC thermistor 734 to the neutral terminal of the AC plug 731. Thereby, the compressor 721 runs and circulates the coolant in the heat-exchange system 720. Therefore, the refrigeration room 713 is being cooled down. When the temperature in the refrigeration room 713 is lower than a certain temperature, the thermostat 732 becomes off. In this case, the AC signal doesn't flow into the compressor line 739. Thus, the compressor 721 is turned off. When the temperature of the condenser 722 goes higher, the resistance of the PTC thermistor 734 becomes higher as well. This leads to decrease the current flow into the compressor 721, leading to a suppressed performance of the compressor 721. When the current to the compressor 721 is too high, the overload protector 733 shuts off the current to the compressor 721.

While the defrost timer 100 selectively couples the active terminal TAB1 to the heater terminal TAB2 at the AC relay RY1, in other words, when the defrost timer 100 executes the step of defrost-on step S300, the AC signal doesn't flow into the compressor line 739, which means the compressor 721 is being turned off. Thereby, the refrigerator 700 performs its defrosting cycles, where the frost and ice on the evaporator 724 will be melted down and removed from the evaporator 724.

§2.3 Second Electric System 730*b*

Figure 13:
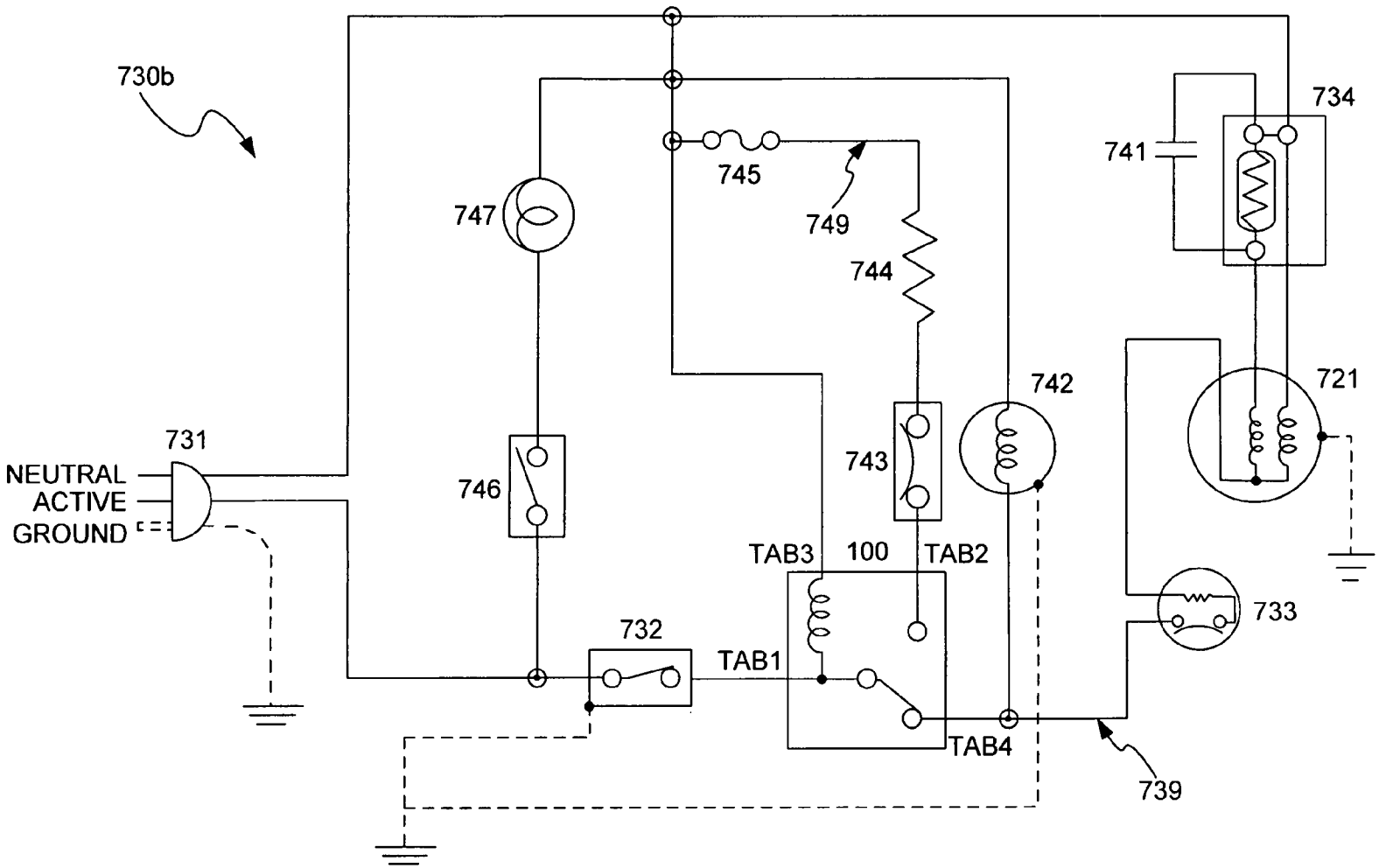
FIG. 13 depicts a schematic circuit diagram of an alternative embodiment of connections between various electric parts of the refrigerator shown in FIG. 10.

FIG. 13 illustrates a schematic circuit diagram of the second electric system 730*b*. The refrigerator 700 having the second electric system 730*b* is often called a fan-type refrigerator. This type of refrigerator is common in more expensive refrigerators, which have more functions. It should be noted that matters with similar explanation as those in the first electric system 730*a* will be omitted in this section. As shown in FIG. 13, the second electric system 730*b* may include an AC plug 731, a thermostat 732, the defrost timer 100, an overload protector 733, the compressor 721, a PTC thermistor 734, a running capacitor 741, a fan 742, a defrost thermostat 743, a heater 744, a thermal fuse 745, a lamp switch 746, and a lamp 747. Since the refrigerator 700 with the second electric system 730*b* includes the heater 744 for defrosting the evaporator 724, the second program is preferably used to defrost the evaporator 724.

In the second electric system 730*b*, the thermostat 732 is provided between the active terminal of the AC plug 731 and the active terminal TAB1 of the defrost timer 100. In other word, the thermostat 732 is coupled in series to the active terminal TAB1 of the defrost timer 100. Thus, the thermostat 732 may be used to turn on and off the power into the defrost timer 100 as well as the compressor 721. The overload protector 733, the compressor 721, the PTC thermistor 734, and the running capacitor 741 are provided on the compressor line 739. The running capacitor 741 is also coupled in parallel to the PTC thermistor 734. This prevents excessive current from flowing into the PTC thermistor 734 when the resistance of the PTC thermistor 734 is low.

In the second electric system 730*b*, the heater terminal TAB2 is coupled to the heater 744. For convenience, the line which connects the heater terminal TAB2 to the neutral terminal of the AC plug 731 is called a heater line 749. On the heater line 749, the defrost thermostat 743, the heater 744 and the thermal fuse 745 are provided in series. The heater 744 is placed in adjacent to the evaporator 724 to defrost the evaporator 724. The defrost thermostat 743 and the thermal fuse 745 are placed adjacent to the heater 744 position to monitor the temperature of the heater 744.

until the time when the thermostat 732 becomes off. Therefore, the defrost timer 100 may resume counting after the thermostat 732 becomes on again. Thus, the time counted by defrost timer 100 reflects the running time, during which the compressor 721 is turned on by the thermostat 732, quite accurately.

While the defrost timer 100 selectively couples the active terminal TAB1 to the heater terminal TAB2, the AC current flows into the heater line 749. In other words, the AC current flows to the defrost thermostat 743, the heater 744, and the thermal fuse 745. Thus, the heater 744 is turned on. Thereby, the heater 744 warms up the evaporator 724. Thereby, frost and ice on the evaporator 724 will be melted down and removed. When the temperature of the heater 744 is higher than a certain temperature, the defrost thermostat 743 becomes off. This shuts off the current to the heater 744, preventing the temperature of the heater 744 from becoming too high. If the temperature of the heater 744 is too high, the thermal fuse 745 fuses. Thereby, the temperature of the heater 744 is prevented from being extremely high.

TABLE 1

| | Current Time | | | | | | | | | | | |
|---|---|---|---|---|---|---|---|---|---|---|---|---|
| | 1:00-2:59 | 3:00-4:59 | 5:00-6:59 | 7:00-8:59 | 9:00-10:59 | 11:00-12:59 | 13:00-14:59 | 15:00-16:59 | 17:00-18:59 | 19:00-20:59 | 21:00-22:59 | 23:00-0:59 |
| Setting Time | 2:00 | 4:00 | 6:00 | 8:00 | 10:00 | 12:00 | 14:00 | 16:00 | 18:00 | 20:00 | 22:00 | 24:00 |
| Switch Pushing Times | 1 | 2 | 3 | 4 | 5 | 6 | 7 | 8 | 9 | 10 | 11 | 12 |

The fan 742 is coupled in parallel to the compressor terminal TAB4 and the neutral terminal of the AC plug 731. Thus, the fan 742 may be turned on and off by the thermostat 732 and the defrost timer 100. The fan 742 is placed near the evaporator 724.

The lamp switch 746 and the lamp 747 are connected to each other in series. They are coupled to the active terminal of the AC plug 731 and the neutral terminal of the AC plug 731 in parallel. The lamp switch 746 is placed such that it may be switched on and off according to opening and closing of the door 712. The lamp 747 is placed in the refrigeration room 713. Thus, in the refrigerator 700 with the second electric system 730*b*, the refrigeration room 713 becomes bright when the door 712 is opened because the lamp switch 746 and the lamp 747 are turned on.

In the second electric system 730*b*, the thermostat 732, the compressor 721 and the fan 742 are connected to the ground terminal of the AC plug 731.

While the defrost timer 100 connects the active terminal TAB1 and the compressor terminal TAB4, the AC signal flows into the compressor line 739 as well as to the fan 742. Thus, the compressor 721 is turned on. At the same time, the fan 742 is also turned on. The fan 742 blows the air that is chilled by the evaporator 724. This chilled air circulates in the refrigeration room 713. Therefore, more homogenous refrigeration is possible in the refrigerator 700 having the second electric system 730*b*. When the temperature in the refrigeration room 713 is lower than a certain temperature, the thermostat 732 becomes off. In this case, the AC current doesn't flow into the defrost timer 100, the compressor line 739 and the fan 742. Thus, the defrost timer 100 doesn't count the time while the compressor 721 is turned off. In addition, since the defrost timer 100 includes the flash memories 632, it may not lose the time information counted by the controller U1 up

What is claimed is:

1. A defrost timer for a refrigerator comprising:

a circuit board;

a first terminal located on the circuit board and coupled to one position of an alternative current source;

a second terminal located on the circuit board and coupled to a heater of the refrigerator;

a third terminal located on the circuit board and coupled to other position of the alternative current source;

a fourth terminal located on the circuit board and coupled to a compressor of the refrigerator;

a switching unit selectively coupled between the first terminal and the fourth terminal;

a first AC line provided on the circuit board coupling the first terminal and the switching unit;

a second AC line provided on the circuit board coupling the second terminal and the switching unit;

a third AC line provided on the circuit board coupling the third terminal and the switching unit; and a fourth AC line provided on the circuit board coupling the fourth terminal and the switching unit, a CPU for controlling the switching unit; and a flash memory for storing data outputted from the CPU, wherein the CPU is configured to:

write periodically a value reflecting a running time of the compressor into the flash memory, and control the switching unit and turn off the compressor when the value reaches a predetermined threshold, and wherein the distance between the third AC line and the fourth AC line is at least 5 mm.

2. A defrost timer for a refrigerator comprising:

a switching unit selectively coupled to a compressor of the refrigerator;

a timer for counting a time;

a CPU for controlling the switching unit according to the time counted by the timer; and a flash memory for storing data outputted from the CPU, wherein the CPU is configured to:

write periodically a value reflecting the time counted by the timer into the flash memory, and control the switching unit and turn off the compressor when the value reaches a predetermined threshold, and wherein the flash memory has a size of 1 kilobyte to 1 megabyte;

wherein the CPU is configured to write periodically the value reflecting the time counted by the timer into the flash memory at an address that is different from an address where the value is written last time.

3. The defrost timer of claim 2, wherein the CPU is configured to write into the flash memory at a predetermined interval.

4. The defrost timer of claim 2, further comprising a time input unit for receiving an input corresponding to a current time and transmitting the input to the CPU, wherein the CPU is configured to adjust the value which reflects the time counted by the timer in response to the input.

5. The defrost timer of claim 4, wherein the time input unit comprises a switch where the input corresponding to the current time is received by pressing the switch for a number of times, and wherein the number of times the switch is pressed is smaller than a numeral represented by time in hour unless the numeral represented by time is 0.

6. The defrost timer of claim 2, wherein the CPU is configured to write periodically the value reflecting the time counted by the timer into the flash memory with an interval of 2 minutes to 2 hours.

7. A defrost timer for a refrigerator comprising:

a switching unit selectively coupled to a compressor of the refrigerator or a heater of the refrigerator;

a CPU for controlling the switching unit; and a flash memory for storing data outputted from the CPU, wherein the CPU is configured to:

write periodically a value reflecting a running time of the compressor into the flash memory, and control the switching unit and turn off the compressor or the heater when the value reaches a predetermined threshold, and wherein the flash memory has a size of 1 kilobyte to 1 megabyte;

wherein the CPU is configured to write periodically the value reflecting running time of the compressor into the flash memory at an address that is different from an address where the value is written last time.

8. The defrost timer of claim 7, wherein the CPU is configured to write the value reflecting the running time of the compressor into the flash memory while the compressor is on, and wherein a current to the CPU is configured to be off when the line to the compressor is on at the switching unit while the compressor is off; and wherein the CPU is configured to retrieve the value from the flash memory after the compressor is turned on.

9. The defrost timer of claim 7, further comprises at least two flash memories, wherein the CPU is configured to write the value reflecting the running time of the compressor:

at an address in one of the flash memories that is different from an address where the value is written last time, and into the same flash memory as long as the same flash memory allows the CPU to rewrite.

10. The defrost timer of claim 7, wherein the CPU is configured to write periodically the value reflecting running time of the compressor into the flash memory with an interval of 2 minutes to 2 hours.

11. A refrigerator having a compressor, a condenser, an evaporator to compress, condense and evaporate a coolant, a thermostat coupled in series to the compressor where the thermostat selectively couples an alternative current source to the compressor, an optional heater to warm the evaporator, and a defrost timer coupled in series to the compressor and the thermostat, wherein said defrost timer is the defrost timer recited in claim 7, and wherein current to the defrost timer is arranged to be off while the current to the compressor is off by the thermostat.

12. A defrost timer for a refrigerator comprising:

a switching unit selectively coupled to a compressor of the refrigerator;

a timer for counting a time;

a CPU for controlling the switching unit according to the time counted by the timer;

a flash memory for storing data outputted from the CPU, wherein the CPU is configured to:

write periodically a value reflecting the time counted by the timer into the flash memory, and control the switching unit and turn off the compressor when the value reaches a predetermined threshold; and a time input unit for receiving an input corresponding to a current time and transmitting the input to the CPU, wherein the CPU is configured to adjust the value which reflects the time counted by the timer in response to the input.

13. The defrost timer of claim 12, wherein the time input unit comprises a switch where the input corresponding to the current time is received by pressing the switch for a number of times, and wherein the number of times the switch is pressed is smaller than a numeral represented by time in hour unless the numeral represented by time is 0.

14. The defrost timer of claim 12, wherein the CPU is configured to write periodically the value reflecting the time counted by the timer into the flash memory with an interval of 2 minutes to 2 hours.

15. The defrost timer of claim 12, wherein the CPU is configured to write periodically the value reflecting the time counted by the timer into the flash memory at an address that is different from an address where the value is written last time.

* * * * *